US008167610B2

(12) United States Patent
Raleigh et al.

(10) Patent No.: US 8,167,610 B2
(45) Date of Patent: May 1, 2012

(54) PREMIX FURNACE AND METHODS OF MIXING AIR AND FUEL AND IMPROVING COMBUSTION STABILITY

(75) Inventors: William F. Raleigh, Bend, OR (US); Robert A. Borgeson, O'Fallon, MO (US); Aaron D. Herzon, Ballwin, MO (US); Allan J. Reifel, Florissant, MO (US); Russell W. Hoeffken, Millstadt, IL (US)

(73) Assignee: Nordyne, LLC, O'Fallon, MO (US)

( * ) Notice: Subject to any disclaimer, the term of this patent is extended or adjusted under 35 U.S.C. 154(b) by 23 days.

(21) Appl. No.: 12/793,318

(22) Filed: Jun. 3, 2010

(65) Prior Publication Data

US 2010/0310998 A1 Dec. 9, 2010

Related U.S. Application Data

(60) Provisional application No. 61/183,934, filed on Jun. 3, 2009.

(51) Int. Cl.
*F23C 5/00* (2006.01)

(52) U.S. Cl. ..... 431/171; 431/8; 431/350; 431/354; 126/116 R

(58) Field of Classification Search ..... 126/110 AA, 126/110 R, 116 R; 431/171, 350, 353, 354, 431/8, 12

See application file for complete search history.

(56) References Cited

U.S. PATENT DOCUMENTS 1,329,559 A 2/1920 Tesla
3,375,842 A 4/1968 Reader
3,461,897 A 8/1969 Kuick
3,472,256 A 10/1969 Hartman
4,449,511 A 5/1984 Hays et al.
4,706,884 A 11/1987 Brauer
4,730,600 A 3/1988 Harrigill
4,779,676 A 10/1988 Harrigill
4,867,673 A 9/1989 Harrigill
4,924,848 A 5/1990 Vaughn
5,178,124 A 1/1993 Lu et al.
5,271,376 A 12/1993 Lu et al.
5,743,727 A 4/1998 Rodgers
5,971,745 A 10/1999 Bassett et al.
5,992,410 A 11/1999 Raleigh et al.

(Continued)

OTHER PUBLICATIONS

Baade, Peter K., Demonstration of tricks and tools for solving self excited combustion oscillation problems, Noise-Con 2008, 12 pages, Jul. 28-30, 2008.

(Continued)

*Primary Examiner* — Alfred Basichas
(74) *Attorney, Agent, or Firm* — Bryan Cave LLP

(57) ABSTRACT

Premix furnace for heating an occupied space while producing lower NOx emissions and methods of mixing air and fuel delivered to a premix burner and of improving combustion stability. A mixing device may be located within an inlet tube, may have a flat surface that is perpendicular to the direction of fuel flow, or may have two surfaces held at substantially opposite angles to induce swirl. A mixing device may be attached to the fuel injector, may be made from a piece of sheet metal, and may have bends and a hole for attachment to the fuel injector. A fluidic diode in the inlet tube may improve combustion stability and may include a hollow frustum or a frustoconical portion, a cylinder concentric with the inlet tube, or a combination thereof. Some embodiments include refractory insulation lining the combustion chamber or may adjust for elevation or fuel characteristics.

24 Claims, 11 Drawing Sheets

U.S. PATENT DOCUMENTS

| | | | | |
|---|---|---|---|---|
| 6,684,878 | B2 | 2/2004 | Ho et al. | |
| 6,889,686 | B2 * | 5/2005 | Specht | 126/110 R |
| 6,923,643 | B2 | 8/2005 | Schultz et al. | |
| 7,241,135 | B2 | 7/2007 | Munsterhuis | |
| 2003/0087213 | A1 | 5/2003 | Reifel et al. | |
| 2008/0318172 | A1 | 12/2008 | Geiger et al. | |
| 2009/0017403 | A1 | 1/2009 | Geiger et al. | |
| 2009/0148798 | A1 | 6/2009 | Geiger et al. | |

OTHER PUBLICATIONS

Baade, Peter K., How to Solve Abnormal Combustion Noise Problems, Sound and Vibration, Jul. 2004.

Control Tips, Flame Rectification, Robertshaw Informational Guide, 3 pages. Jun. 2008.

Henkenius, M., New Heating and Cooling Systems, New Heating and Cooling Systems are More Efficient Than Ever, http://www.popularmechanics.com/hotm_journal/home_improvement/1275001.html?page=2, 2 pages. Sep. 2003.

Raleigh, W., Premix Burners—Technology Advancement and Engineering Challenge, Presented to American Society o Gas Engineers 2008 National Technical Conference, Las Vegas, Nevada, Jun. 6, 2008, 12 pages. 2008.

* cited by examiner

PREMIX FURNACE AND METHODS OF MIXING AIR AND FUEL AND IMPROVING COMBUSTION STABILITY

RELATED PATENT APPLICATIONS

This patent application claims priority to U.S. Provisional Patent Application No. 61/183,934, filed on Jun. 3, 2009, titled LOW NOx FURNACE AND METHODS OF MAKING AND CONTROLLING SAME, naming four of the same inventors that are listed above. The contents of that provisional patent application are incorporated herein by reference. Certain terms, however, may be used differently in these two patent applications.

FIELD OF THE INVENTION

This invention relates to premix burners, furnaces, and methods of making and improving such things. Particular embodiments concern fuel burner systems and furnaces that produce less NOx emissions than alternative burners or furnaces.

BACKGROUND OF THE INVENTION

Various fuels have been burned for some time to produce heat for various purposes including heating spaces that people occupy, such as within buildings. Combustion of fuels has produced various pollutants that have been released into the atmosphere, and alterations have been made to equipment to reduce the quantity of certain pollutants that have been emitted.

In various examples, natural gas and other fuels have been introduced into heat exchanger tubes in furnaces and burned as the fuel mixes with air. Such processes, however, have resulted in the production of a certain amount of oxides of Nitrogen (NOx) during the combustion process. It has been known for some time that NOx production can be reduced significantly by mixing air and fuel in advance of combustion and then burning a controlled and substantially homogeneous mixture of air and fuel. But premix burners have been plagued with noise resulting in oscillations of combustion and flow that have prevented premix burners from becoming workable in furnaces for occupied structures.

References that may provide useful background information include U.S. Pat. Nos. 5,971,745 (Bassett), 6,923,643 (Schultz), and 7,241,135 (Munsterhuis), as well as *Demonstration of tricks and tools for solving self excited combustion oscillation problems*, by Peter K. Blaade (NOISE-CON 2008, Jul. 28-30, 2008), and *How to Solve Abnormal Combustion Noise Problems*, by Peter K. Baade (SOUND AND VIBRATION/JULY 2004).

Needs or potential for benefit or improvement exist for burners, furnaces, and methods of making and controlling such apparatuses that reduce pollution (e.g., in comparison with alternative technologies), such as NOx emissions, from furnaces, for example, but that do not produce unacceptable levels of noise. Needs and potential for benefit or improvement also exist for burners, furnaces, and methods that do not require special installation procedures, that compensate for different elevations, and that compensate for different heating characteristics of the fuel. Needs or potential for benefit or improvement also exist for devices or apparatuses that produce less pollution than alternative burners, such as NOx emissions, for example, that are suitable for use in furnaces, HVAC systems, or HVAC units, for example that more-effectively avoid producing pollution (e.g., NOx emissions) that are inexpensive, that can be readily manufactured, that are easy to install, that are reliable, that have a long life, that are light weight, that are efficient, that can withstand extreme environmental conditions, or a combination thereof, as examples.

Needs or potential for benefit or improvement also exist for devices or apparatuses that reduce the production of pollution (e.g., in comparison with alternatives), such as NOx emissions, from furnaces, for example, that are quiet and that start reliably under a range of different conditions. In addition, needs or potential for benefit or improvement exist for furnaces and HVAC units that include such devices or apparatuses that reduce pollution, as well as buildings having such units, systems, devices, or apparatuses.

Further, needs or potential for benefit or improvement exist for methods of controlling, manufacturing, and distributing such furnaces, HVAC units, buildings, systems, devices, and apparatuses. Other needs or potential for benefit or improvement may also be described herein or known in the HVAC or pollution-control industries. Room for improvement exists over the prior art in these and other areas that may be apparent to a person of ordinary skill in the art having studied this document.

Figure 1:
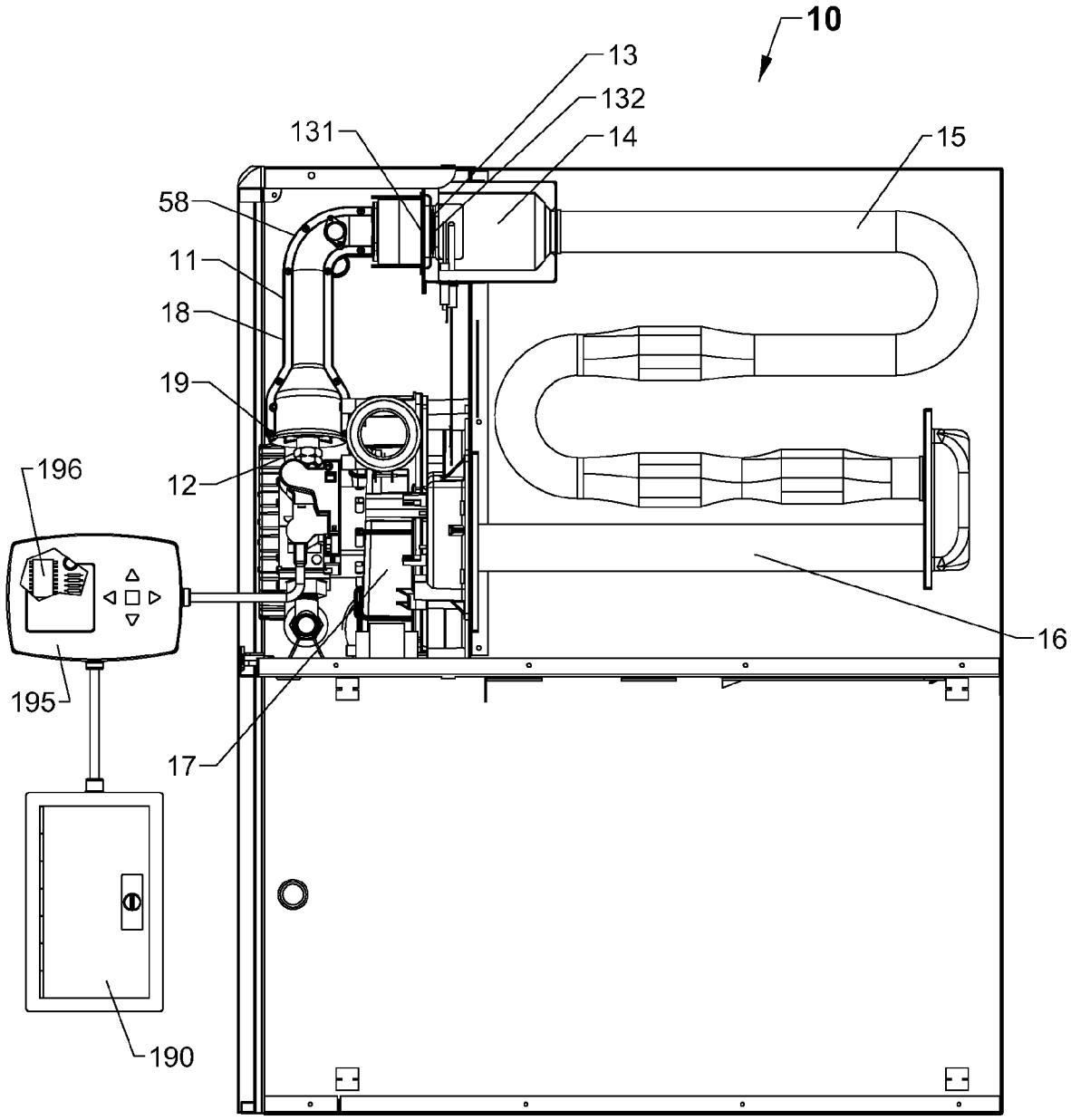
FIG. 1 is a side view illustrating various components of a premix burner, for example, of a furnace for heating an occupied space.

These drawings illustrate, among other things, examples of certain aspects of particular embodiments of the invention. Other embodiments may differ. Various embodiments may include aspects shown in the drawings, described in the specification, shown or described in other documents that are incorporated by reference, known in the art, or a combination thereof, as examples.

SUMMARY OF PARTICULAR EMBODIMENTS OF THE INVENTION

This invention provides, among other things, furnaces (e.g., for heating an occupied space), HVAC units, HVAC systems, methods, and buildings, many of which reduce NOx formation (e.g., in comparison with various alternatives), reduce noise, or both. Various embodiments provide, for example, as an object or benefit, that they partially or fully address or satisfy one or more of the needs, potential areas for benefit, or opportunities for improvement described herein, or known in the art, as examples. Certain embodiments provide, for example, devices or apparatuses that produce less pollution, such as NOx emissions, from furnaces, for example, that provide an acceptable level of noise or that produce less noise, or a combination thereof, as examples.

In addition, particular embodiments provide, as objects or benefits, for instance, furnaces, HVAC units, and methods (e.g., of controlling premix burners) that produce less pollution such as NOx emissions (e.g., in comparison with alternatives), that provide an acceptable level of noise or that reduce noise (e.g., in comparison with alternatives), or a combination thereof, or buildings having such units, systems, devices, or apparatuses, as further examples. Further, some embodiments provide methods of manufacturing such furnaces, HVAC units, buildings, systems, devices, or apparatuses, as examples.

Specific embodiments of the invention provide various furnaces, for example, for heating an occupied space. Such furnaces may produce lower than standard NOx emissions, for instance. In a number of embodiments such a furnace may include, for example, an air inlet passage, a fuel injector, a mixing device, a burner plate, a combustion chamber, heat exchanger tubes, and a fan. The air inlet passage may include, for example, an inlet tube having an inlet end, and the fuel injector may be mounted at the inlet end of the inlet tube. The fuel injector may include, for example, an orifice for dispensing the fuel, and the fuel injector may be oriented to dispense the fuel into the inlet end of the inlet tube. Space between the fuel injector and the inlet tube may permit air to enter the inlet tube around the fuel injector, for example.

In a number of embodiments, the mixing device may be downstream of the fuel injector, and the mixing device may mix the air and fuel prior to combustion. Further, the burner plate may be located downstream of the mixing device, and may separate unburned air and fuel mixture on an upstream side of the burner plate from burning air and fuel and products of combustion on a downstream side of the burner plate. The burner plate may include, for example, multiple ports therethrough. The air and fuel mixture may pass through the ports in the burner plate. Still further, the combustion chamber may be located downstream of the burner plate, and may be defined on an upstream side by the burner plate.

Some embodiments include multiple parallel heat exchanger tubes that are downstream of the combustion chamber for transferring heat from the products of combustion, for example, to air to be delivered to the occupied space. In addition, the fan may be located downstream of the heat exchanger tubes, and may draw air through the air inlet passage, mixing device, burner plate and combustion chamber. Further, in a number of embodiments, the fan may draw products of combustion through the heat exchanger tubes. Even further, in certain embodiments, the burner plate may be attached by being sandwiched between opposing surfaces, for example, so that the burner plate slides against the opposing surfaces when the burner plate expands and contracts as the furnace cycles on and off.

In certain embodiments, the mixing device may be located inside the air inlet tube. The mixing device may include, for instance, a flat surface that may be substantially perpendicular to the direction of fuel flow exiting the injector and that may be located in front of the orifice of the fuel injector. In a number of embodiments, mixing device may include, for instance, at least one flat metal plate that may be located downstream of the orifice of the fuel injector. In particular embodiments, the mixing device may include, for instance, two surfaces at the inlet end that are held, for example, at substantially opposite angles so as to induce swirl in the inlet tube. In some embodiments, the mixing device may include, for instance, two surfaces that are located downstream of the orifice of the fuel injector that are held at substantially opposite angles inducing swirl in the fuel being dispensed from the orifice of the fuel injector and inducing swirl in the incoming air, whereby mixing of the two flows may be promoted.

Further, in various embodiments, the mixing device may be attached to the fuel injector. In some embodiments, the mixing device may include, for instance, a piece of sheet metal that may have, for example, multiple bends. In particular embodiments, the piece of sheet metal may include, for instance, a center having a hole, for example, that attaches the piece of sheet metal to the fuel injector. In certain embodiments, the piece of sheet metal may include, for instance, two arms extending from the center to two ends each located in front of the orifice of the fuel injector. In some embodiments, each arm may be separated from the center by a first bend, and each end may be separated from one of the arms by a second bend, for example.

In a number of embodiments, a fluidic diode may be located inside the inlet tube. The fluidic diode may be oriented to provide greater restriction to backflow than to forward flow, for example. In particular embodiments, the fluidic diode may include, for instance, a hollow frustum. Further, in some embodiments, the fluidic diode may include a frustoconical portion that may include, for example, a larger circular opening and a smaller circular opening. The larger circular opening may be closer to the fuel injector than the smaller circular opening, for example. In certain embodiments, the fluidic diode may further include, for instance, a circular cylinder extending, for example, from the smaller circular opening away from the fuel injector. In some embodiments, the circular cylinder may be substantially concentric with the inlet tube, for example.

In some embodiments, the inlet tube may include, for instance, a bend. In particular embodiments such a bend may be (e.g., have an angle) between 22.5 and 135 degrees, for example. Further, in some embodiments, the combustion chamber may be lined with refractory insulation. In particular embodiments, however, the refractory insulation may be omitted from at least one portion of the combustion chamber that includes the ports. Even further, in some embodiments, the furnace may include, for example, an adjustment input mechanism to adjust air/fuel ratio or excess air, and a controller. The controller may include, for example, a digital processor. In various embodiments, the controller may receive input from the adjustment input mechanism and may be in control of (e.g., at least one of) the fuel injector, a fuel or gas regulator, an air damper, or the fan, as examples, and may control (e.g., at least one of) a fuel delivery rate or an air flow rate through the air inlet passage, as examples. In a number of embodiments, the controller may control combustion stoichiometry, for instance, using input from the adjustment input mechanism. In particular embodiments, for example, the adjustment input mechanism may receive an input of elevation, and the controller may use the input of elevation to adjust the air/fuel ratio or excess air, for example, to account for the elevation of the installation of the furnace. Further, in some embodiments, the adjustment input mechanism may be configured to receive an input of heat delivery characteristics of the fuel gas, and the controller may be configured to use the input of heat delivery characteristics of the fuel gas to adjust the air/fuel ratio or excess air to account for the heat delivery characteristics of the fuel gas delivered to the furnace.

Other specific embodiments include various methods concerning premix burners or premix furnaces. Examples include a number of methods of mixing air and fuel delivered to a premix burner, for example, of a furnace for heating an occupied space. Such a method may include, for example, at least the acts of forming or obtaining a piece of sheet metal and attaching the piece of sheet metal to a fuel injector of the premix burner. The piece of sheet metal may have multiple bends, for example, and the act of attaching the piece of sheet metal to the fuel injector of the premix burner may include attaching the piece of sheet metal so that at least a portion of the piece of sheet metal extends over the downstream side of the orifice of the fuel injector that dispenses the fuel. Other specific embodiments include various methods of improving combustion stability in a premix burner, for example, of a furnace for heating an occupied space. Such a method may include, for example, (e.g., in any order) at least the acts of forming or obtaining a fluidic diode, and installing the fluidic diode in an inlet tube of the premix burner. In a number of embodiments, the fluidic diode may be installed in the inlet tube between a fuel injector and a combustion chamber. Further, in various embodiments, the fluidic diode may be oriented to provide greater restriction to backflow than to forward flow.

In addition, various other embodiments of the invention are also described herein, and other benefits of certain embodiments may be apparent to a person of ordinary skill in the art.

DETAILED DESCRIPTION OF EXAMPLES OF EMBODIMENTS

A number of embodiments of the subject matter described herein include furnaces, heating, ventilating, and air conditioning (HVAC) units, HVAC systems, devices for reducing pollution (e.g., in comparison with alternatives), NOx-reduction apparatuses, and methods of manufacturing furnaces, HVAC units, HVAC systems, buildings, and devices for reducing pollution, NOx-reduction apparatuses, for example. As used herein "HVAC units" include air conditioning units, for example, direct expansion units, which may be combined with gas furnaces, for instance. Various embodiments include improvements that reduce pollution production (e.g., over prior technology), such as NOx emissions, for instance. Various embodiments of the subject matter described herein include a means for reducing pollution production or specifically a means for reducing NOx emissions, as examples. In addition, various embodiments include a means for mixing air and fuel for a premix burner, and means for improving combustion stability, for example, in a premix burner.

Certain embodiments of the subject matter described herein also include various procedures or methods of providing or obtaining different combinations of the components or structure described herein. Such procedures may include acts such as providing or obtaining various components described herein, and providing or obtaining components that perform functions described herein, as well as packaging, advertising, and selling products described herein, for instance. Particular embodiments of the subject matter described herein also include various means for accomplishing the various functions described herein or apparent from the structure described. Other embodiments may also be apparent to a person of ordinary skill in the art having studied this document.

Various embodiments concern or involve premix burners. Very low NOx emission can be accomplished with certain premix burners. Although not all embodiments will provide such performance, at CO2 levels of about 8.5%, for example, NOx emission can be in the area of 20-25 ppm air-free (about 10-12 ng/J, depending on furnace efficiency). Premix burners, however, may be sensitive to changes in fuel gas, ratio of methane to ethane, WOBBE index of the fuel, altitude of installation, and the like. Lean mixtures may result in hard starts or stalls, as examples, and rich mixtures may result in excessive noise or oscillation, as examples, or lack of combustion stability. As used herein "rich" does not necessarily mean richer than stoichiometric, but rather, means richer than optimal. In other words, "richer" may mean that there is less excess air. In addition, CO and NOx emissions may depend upon mixture. In a number of embodiments, adjustments to the air/fuel mixture ratio may be made to compensate for variations in these factors, (e.g., among other things). In different embodiments, open loop or closed loop (or feedback) control systems may be used. In some embodiments, adjustments may be made manually, for instance, by the installer, by the owner, by an owner's representative, or at the factory, to adjust for the location where a furnace or unit is or is to be installed, for example.

In some embodiments, on the other hand, one or more sensors may be used to provide feedback to control mixture, for instance, automatically, as another example. Various sensors may be used, in different embodiments, and sensors may be selected for longevity, accuracy, reliability, or a combination thereof, as examples. Some embodiments may combine manual inputs and automatic adjustments, as other examples. Automatic adjustments may be performed repeatedly, at regular intervals of time, or continuously, for example. Mixture may be controlled, in different embodiments, by changing inducer fan (e.g., fan 17 described below) speed (e.g., using a variable-speed drive), by throttling air flow (e.g., with a damper), or by adjusting the rate of fuel delivery, as examples. Sensors may sense flame condition, the products of combustion, or oscillations (e.g., noise, vibration, or pressure pulsations from the burner), as examples.

A number of embodiments are applied to a condensing furnace, for example, rather than a non-condensing furnace. That does not mean that all embodiments are limited to a condensing furnace, but there may be advantage in condensing furnaces, for example, in the efficiency of the furnace. In many embodiments, an inducer or fan draws combustion products through an air-heating exchanger (i.e., a heat exchanger, such as heat exchanger 15, 16, or both, described in more detail below). In some embodiments, the exchanger may be similar to hardware that is used in other furnaces having conventional (non-premix) burners, for example. In certain embodiments, a premix burner may be applied to a small combustion chamber (e.g., 14 described below) at the inlet of the heat exchanger, for example. In some embodiments, the furnace utilizes a fuel or gas control and variable speed inducer. The gas control can be electronically controlled, in a number of embodiments, to provide a specified gas flow rate (e.g., by establishing the necessary gas pressure at a metering orifice). Likewise, the inducer speed can be electronically controlled, in some embodiments, to provide required system flow, which may provide control of mixture, aeration, or excess air, for example.

In certain embodiments, a feature is to sense and control excess air so that the combustion system can be operated effectively and reliably under differing conditions, for example. In various embodiments, various sensing approaches may be used, such as differential flame rectification from two flame sensors, low frequency visible light (red/yellow) signal from flame or glowing refractory material (e.g., utilizing cadmium sulfide cell or similar), ultra violet light flame sensor, flame conductivity, inherent flame voltage, or a combination thereof, as examples. Besides sensing of excess air, other control protocols of varying degrees of sophistication or of a more open-loop nature may be used, in some embodiments.

A number of embodiments of the subject matter herein are furnaces, for instance, for heating an occupied space (e.g., while reducing NOx emissions in comparison with alternatives or keeping NOx emissions within acceptable levels). In various embodiments, such a furnace may include, for example, an air inlet passage (e.g., 11 described below), a fuel injector (e.g., 12 described below), and a mixing device (e.g., 21, 31, or 41 described below) downstream of the air inlet passage and downstream of the fuel injector for mixing the air and fuel prior to combustion. Certain embodiments further include a burner plate (e.g., 13 described below) downstream of the mixing device separating unburned air and fuel mixture on an upstream side of the burner plate from burning air and fuel and products of combustion on a downstream side of the burner plate. In a number of embodiments, the burner plate may be flat, while in other embodiments, the burner plate may be curved. In some embodiments, the burner plate may include, for example, multiple holes, orifices, or ports (e.g., 63 described below) therethrough for passage of the air and fuel mixture through the burner plate.

A number of embodiments further include a combustion chamber (e.g., 14 described below) downstream of the burner plate, for example. In various embodiments, the combustion chamber may have a particular volume. A number of embodiments further include multiple parallel heat exchanger tubes (e.g., 15, 16, or both, described below) downstream of the combustion chamber for transferring heat from the products of combustion to air (e.g., return air) to be delivered to the occupied space. Various embodiments also include a fan (e.g., 17 described below) downstream of the heat exchanger tubes for drawing air (e.g., combustion air) through the air inlet passage, mixing device, and burner plate, and for drawing products of combustion through the heat exchanger tubes, for example.

Some embodiments further include a sensor (e.g., 133 described below) for detecting air/fuel ratio, excess air, or a condition of the burning air and fuel, as examples, and a controller (e.g., 195 described below) receiving input from the sensor and in control of at least one of the fuel injector, an air damper, or the fan, as examples, and controlling at least one of a fuel delivery rate or an air flow rate through the air inlet passage. In particular embodiments, the controller controls combustion stoichiometry (e.g., excess air) using input from the sensor, for example. Other embodiments, however, may function satisfactorily without such a sensor, or even without such a controller.

In various embodiments, instead of a sensor, or in addition thereto, the furnace may include an adjustment input mechanism (e.g., 190 described below) for adjusting air/fuel ratio or excess air, as another example. In some such embodiments, the controller, which may be or include a digital processor, for example, may receive input from the adjustment input mechanism and may be in control of the fuel injector, a fuel regulator, an air damper, the fan, or a combination thereof, as examples. In these embodiments, the controller may control the fuel delivery rate or the air flow rate through the air inlet passage, or may control combustion stoichiometry using input from the adjustment input mechanism, for example. A gas or fuel regulator may be a pressure regulator, for example, that may establish the pressure that motivates flow through the fuel injector, for example. In other embodiments, a fuel regulator may be a flow regulator, as another example.

In particular embodiments, the adjustment input mechanism may be configured to receive an input of elevation, for example, and the controller may be configured to use the input of elevation to adjust the air/fuel ratio or excess air to account for the elevation of the installation of the furnace, for instance. The controller may use the input of elevation, for instance, to maintain substantially the same air/fuel ratio at different elevations, for example, by adjusting the air flow rate or fuel flow rate. Further, in certain embodiments, the adjustment input mechanism may be configured to receive an input of heat delivery characteristics of the fuel gas, as another example, and the controller may be configured to use the input of heat delivery characteristics of the fuel gas to adjust the air/fuel ratio or excess air to account for the heat delivery characteristics of the fuel gas delivered to the furnace, for instance.

In various embodiments having a sensor, or otherwise, the mixing device may include, for example, a tube, for instance, having a round cross section, having a substantially constant diameter, or both. Mixing in an entrance tube (e.g., before the burner plate) may be very effective, in some embodiments. In certain embodiments, the tube has a length and the length is between five and twenty times the diameter, for instance. Further, in some embodiments, the tube may include, for example, a bend, for instance, between 22.5 and 135 degrees, and in some embodiments, the tube may have multiple bends. In various embodiments, the tube has only one bend or has only two bends, as examples. In different embodiments, the tube may include, for example, a bend between 60 and 120 degrees, a bend between 75 and 105 degrees, a bend between 30 and 60 degrees, a bend between 40 and 50 degrees, or a combination thereof, as examples.

Different size or capacity furnaces may be made, which may have different size (e.g., cross-sectional area) tubes, such as mixing tubes, heat exchanger tubes, or the like. In some embodiments, different size furnaces may have tubes sized to have substantially equal velocities, for example, to assure adequate mixing (e.g., in mixing tubes) for smaller units and yet to prevent excessive pressure drop in larger size furnaces. In particular embodiments, a single tube size may be used for different size furnaces or burners, and inserts may be installed within the tubes for smaller size units to reduce the diameter or cross-sectional area and to increase the velocity. In certain embodiments, other mixing tube embodiments may be used that may have similar performance or function.

Further, some embodiments may include mixing devices, in addition to the inlet tube (e.g., inside the inlet tube). Various examples are described herein and shown in the drawings. Such mixing devices may provide better mixing, require shorter inlet tubes, allow for larger diameter inlet tubes with less flow restriction, provide for less flow restriction overall, provide a more homogeneous mixture, provide more stable combustion, prevent or reduce oscillations or noise, or a combination thereof, as examples. In some embodiments, use of separate mixing devices may reduce cost, reduce size, reduce weight, allow more inlet tube design options, etc.

In a number of embodiments, the combustion chamber may be lined, for example, with a refractory material such as a porous refractory insulation, which may dampen oscillation. In addition, a refractory material lining the combustion chamber may reduce the temperature of the material (e.g., metal) forming the combustion chamber, which may promote material longevity, reduce oxidation, reduce thermal expansion (e.g., and resulting stress and fatigue), and may also subject components outside the combustion chamber to less heat.

In various embodiments, the combustion chamber may contain an igniter (e.g., 133 described below) for starting the furnace. The igniter may be a spark igniter, for example, and may ignite the flame with an electrical spark, for instance. Or, in other embodiments, the igniter may be a hot surface igniter, as another example. Furthermore, in some embodiments, the burner plate may have a plate cross-sectional area and the combustion chamber may have a chamber cross-sectional area that is substantially equal to the plate cross-sectional area. As used herein, "substantially equal to" means within plus or minus 10 percent. Moreover, in some embodiments, the burner plate has a plate cross-sectional area that is rectangular, and in particular embodiments, the burner plate has a plate cross-sectional area that has rounded ends, rounded shoulders, or rounded corners, for instance.

Further, in certain embodiments, the combustion chamber may have a chamber cross-sectional area that is rectangular, and in particular embodiments, the combustion chamber may have a chamber cross-sectional area that has rounded ends, rounded shoulders, or rounded corners, as examples. In some embodiments, the combustion chamber may have a chamber volume that is greater than 100 cubic inches, a chamber volume that is less than 150 cubic inches, a chamber volume that is less than 125 cubic inches, or a combination thereof, as examples. In particular embodiments, for example, the burner may have a nominal full input rate of 72 kBtu/h, fired into four tubes. Furnaces with higher or lower input may have, in various embodiments, volume changes consistent with a width change of 2.5" per tube or per 18 kBtu/h, as examples. The input per unit volume may stay about the same, in a number of embodiments, potentially with a slight deviation due to end effects, for instance.

In some embodiments, the combustion chamber may have a volume of about 1.5 cubic inches per 1000 Btu/h of energy input rate or heat input rate, for example. Other furnaces, for comparison, range from about 2.4 to 7.2 kBtu/h (e.g., for some low-emission premix pool heaters and other residential and light commercial boilers). As used herein, "about", when referring to a quantity or dimension, means plus or minus 10 percent. In different embodiments, the combustion chamber has a volume of about 1.0 cubic inches per 1000 Btu/h, about 1.1 cubic inches per 1000 Btu/h, about 1.2 cubic inches per 1000 Btu/h, about 1.3 cubic inches per 1000 Btu/h, about 1.4 cubic inches per 1000 Btu/h, about 1.5 cubic inches per 1000 Btu/h, about 1.6 cubic inches per 1000 Btu/h, about 1.7 cubic inches per 1000 Btu/h, about 1.8 cubic inches per 1000 Btu/h, about 1.9 cubic inches per 1000 Btu/h, or about 2.0 cubic inches per 1000 Btu/h, as examples. Other embodiments, however, may differ.

In some embodiments, the size, spacing, arrangement, or a combination thereof, of the holes or ports through the burner plate may impact performance. In addition, in a number of embodiments, burner sealing integrity may be important. Burners that are not sealed well may operate erratically, generate higher NOx, or both, as examples. In certain embodiments, the ports through the burner plate may include, for example, multiple first holes, for instance, having a first hole diameter substantially equal to 1.25 mm, multiple second holes, for example, having a second hole diameter substantially equal to 0.8 mm, or both, and in some embodiments, the ports through the burner plate may include, for example, multiple first holes that are each surrounded by multiple second holes.

In some embodiments, the multiple second holes surrounding each of the first holes may all be substantially equal distant from the first hole that the second holes surround, for example, may all be located on a circle, or a combination thereof, as examples. In various embodiments, the circle may have a diameter that is substantially equal to 2.8 mm, 3.2 mm, 3.5 mm, 3.8 mm, 4.2 mm, 4.5 mm, 5.0 mm, or 5.5 mm, as examples. In particular embodiments, the multiple second holes surrounding each of the first holes may all be substantially equal distant from adjacent second holes surrounding the same first hole, for instance.

In a number of embodiments, the multiple first holes may be arranged in multiple shapes, each shape having between 25 and 250 first holes, each shape having between 50 and 150 first holes, or each shape having between 50 and 100 first holes, as examples. In particular embodiments, the shapes may be polygons, the shapes may have eight sides, the shapes may be rectangles, the shapes may be squares, the shapes may have straight sides, or a combination thereof, as examples. In some embodiments, the multiple first holes may be arranged in multiple shapes connected by multiple carryover holes, but in other embodiments, carryover holes between the shapes may be lacking.

Figure 6:
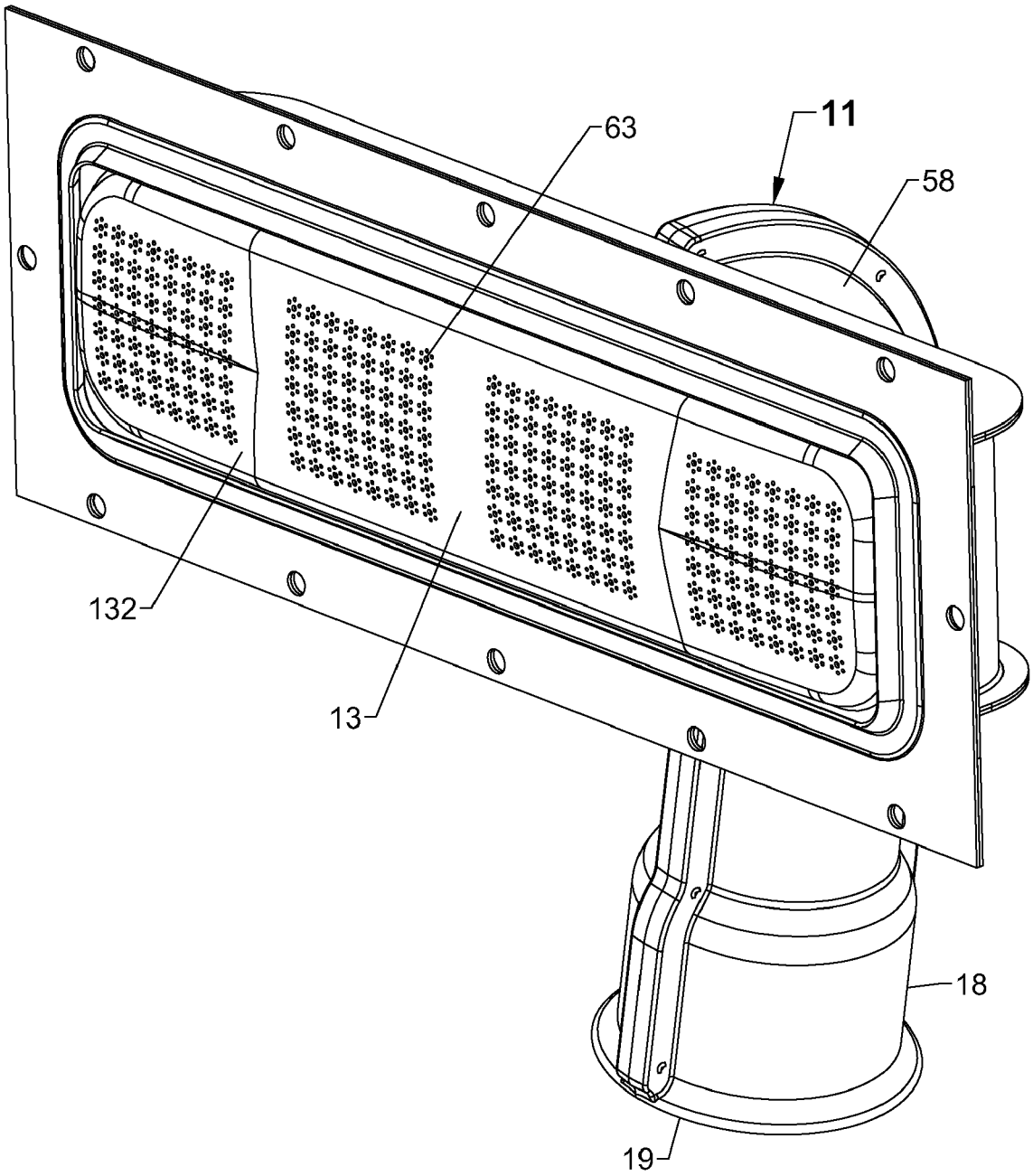
FIG. 6 is an isometric view of the inlet tube and burner plate of FIG. 5, illustrating, among other things, the port pattern in the burner plate.
Figure 7:
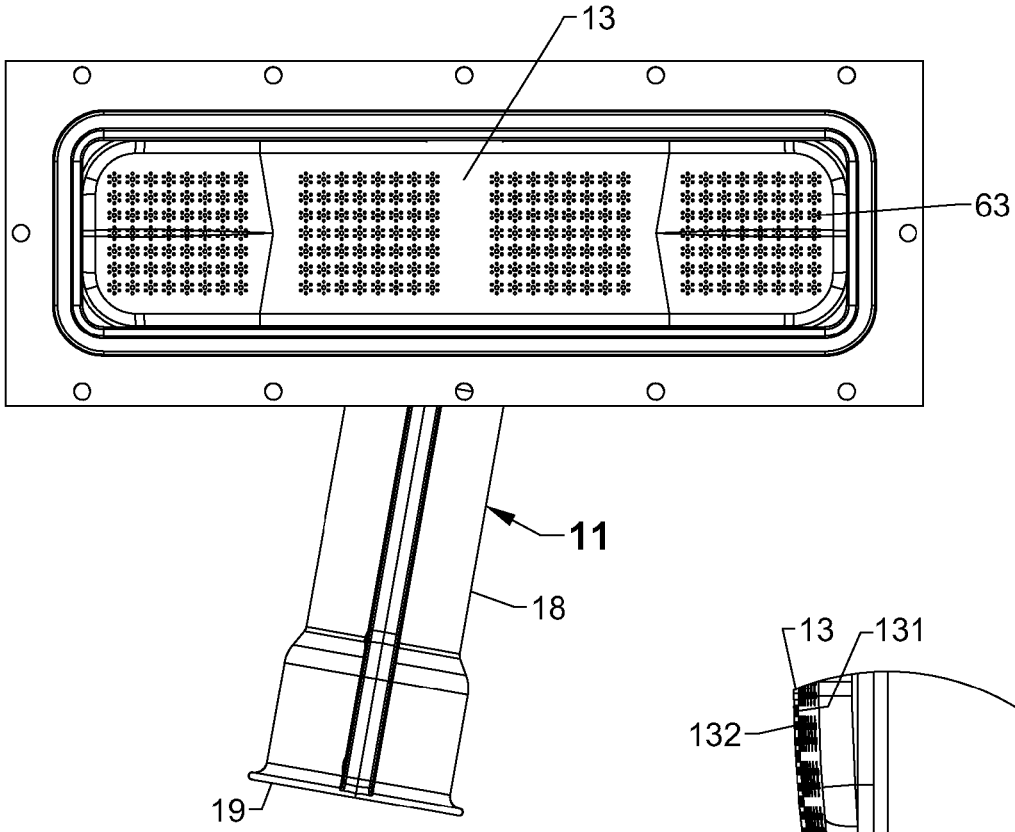
FIG. 7 is an end view of the inlet tube and burner plate of FIGS. 5 and 6.

In certain embodiments, the multiple first holes may be substantially equally spaced from adjacent other first holes in the shape, the multiple first holes may be arranged in multiple substantially identical shapes, or both, as examples. Moreover, in some embodiments, the multiple first holes may be arranged in four shapes, for example. In other embodiments, on the other hand, the multiple first holes may be arranged in one, two, three, five, six, seven, eight, nine, or ten shapes, as other examples. Further, in various embodiments, the multiple first holes may be arranged in multiple lines, the multiple first holes may be arranged in multiple columns, the multiple first holes may be arranged in multiple rows, or a combination thereof, as examples. In various embodiments, the number of holes may be related to the nominal input rate (e.g., of 18 kBtu/h per heat exchanger tube, for instance, of heat exchanger 15) and, in some embodiments, to the tube diameter, as examples. In a particular embodiment, for example, 56 first holes in each shape are arranged in a rectangle in seven rows and eight columns, and four such shapes are provided. (See, for example, FIGS. 6 and 7.)

In various embodiments that include a sensor, the sensor may be or include, for example, an oxygen sensor, a flame ionization sensor, a differential flame rectification sensor, a chemiluminescence sensor, a radiant heat color sensor, a flame voltage sensor, a flame temperature sensor, a microphone, a vibration sensor, a pressure sensor, an oscillation sensor, or a combination thereof, as examples. Further, in certain embodiments, the furnace may include, for example, a frequency analyzer, for instance, receiving input from the sensor, in communication with the controller, or both.

As mentioned, a number of embodiments reduce noise produced by a premix burner or furnace. Certain things that have been found to be significant in quieting the burner or furnace in particular embodiments include: (1) increased pressure drop through the burner face, which may have an acoustic damping effect; (2) increased combustion chamber volume, which may cause less restriction of expansion, reduced pressure pulses, or both; (3) increased surface and volume of refractory material due to the larger chamber, which may result in improving acoustic damping; and (4) increased spacing of holes within the 7-hole set (e.g., six second holes surrounding a first hole), which may increase the ability of flamelets to accommodate pressure pulses without driving air/fuel mixture back through the ports, for example.

Other embodiments include various methods, for instance, of making a premix furnace for heating an occupied structure, for example, which may include, for instance, a number of acts of obtaining or providing a combination of the components previously listed or described herein, as examples. Other embodiments include various HVAC units, HVAC systems, and buildings that include, for example, a furnace described herein. Further embodiments include various methods of reducing noise from a premix burner that may include, for example, an act of increasing velocity of an air and fuel mixture through holes or ports in a burner plate. Moreover, various embodiments of methods of reducing noise from a premix burner may include, for example, an act of increasing combustion chamber volume, or both such acts. Furthermore, a number of embodiments of methods may include, for example, acts of obtaining or providing various combinations of the components listed herein.

In a number of embodiments, premix burners may start better with a richer mixture than what is optimal for efficiency and low emissions during steady state operation, for example. Specific embodiments of methods of controlling a premix burner may include, for example (e.g., in the following order) at least the acts of starting the burner with a first air and fuel mixture ratio, igniting the burner, and changing the air and fuel mixture ratio as the burner warms up to a second air and fuel mixture ratio, for instance, wherein the first air and fuel mixture ratio has more fuel per unit of air than the second air and fuel mixture ratio.

In various embodiments, the air and fuel mixture ratio is controlled by changing the rotational speed of a fan (e.g., inducer) used to move combustion air through the burner, by modulating a fuel valve to adjust a rate of fuel delivery to the burner, by modulating a damper used to throttle movement of combustion air through the burner, or a combination thereof, as examples. In some embodiments, the act of changing the air and fuel mixture ratio as the burner warms up may include, for example, measuring time from the act of igniting the burner and changing the air and fuel mixture ratio as a function of that time.

Further, in some embodiments, the act of changing the air and fuel mixture ratio as the burner warms up may include, for example, measuring a temperature, for instance, with a temperature sensor, and changing the air and fuel mixture ratio as a function of that temperature, as another example. In some embodiments, the temperature may be sensed at the inlet of the inducer or fan during pre-purge, for example. The control may adjust inducer speed (or fuel input), in some embodiments, to provide an air-fuel mixture ratio that provides more reliable ignition, for example. An inducer speed change may essentially provide an adjustment of air mass flow (e.g., made per the perfect gas law), for instance, to provide a more-ideal air-fuel mixture. In particular embodiments, temperature may also (or instead) be measured (e.g., with a second sensor) of the fuel gas at the injector orifice, for example, since density also affects flow through an orifice.

Depending on the altitude of the installation, qualities of the fuel, and other variables, satisfactory settings for starting conditions may vary, and some embodiments may provide for or compensate for such conditions. In some embodiments, a method may include, for instance, after the act of igniting the burner, an act of detecting whether the burner has successfully ignited, and if the burner has not successfully ignited, repeating the act of igniting the burner at a different air and fuel mixture ratio. In a number of embodiments, such a process may be repeated at different mixtures (e.g., richer or leaner) until successful ignition occurs. Moreover, certain embodiments may include, for example, an act of remembering (e.g., automatically) a successful ignition air and fuel mixture ratio that was being provided when the burner successfully ignited, and starting with that successful ignition air and fuel mixture ratio when the burner is ignited at a later time.

Furthermore, some embodiments may include, for example, an act of remembering a successful ignition air and fuel mixture ratio that was being provided when the burner successfully ignited, remembering a temperature condition when the burner successfully ignited, and starting with that successful ignition air and fuel mixture ratio when the burner is ignited at a later time at the temperature condition. Certain embodiments may include, for example, an act of measuring the temperature condition when the burner successfully ignited using a temperature sensor, and evaluating using the sensor whether the temperature condition exists when the burner is ignited at a later time, for example. In some embodiments, the act of changing the air and fuel mixture ratio as the burner warms up may include, for example, gradually changing the air and fuel mixture ratio over a period of time of at least 5 seconds, gradually changing the air and fuel mixture ratio over a period of time of no more than 10 seconds, or both, as examples. In some embodiments, however, the act of changing the air and fuel mixture ratio as the burner warms up may include, for example, gradually changing the air and fuel mixture ratio over a period of time of at least 10 seconds, as another example.

Certain embodiments may include indicator lights, error codes, records of attempts, or the like, which may be used by service personnel to diagnose problems if a furnace fails to start, for example, or otherwise fails to perform satisfactorily. Diagnostic information may help service personnel to identify a source of the problem (e.g., a bad component, physical blockage, damage, or the like) or may help them to make manual adjustments that will provide better performance, as another example. In some embodiments, diagnostic software may help to diagnose problems or obtain information on local conditions that may require compensating adjustments in order to obtain desired performance. In some embodiments, units may be able to communicate with external networks regarding problems or optimization of adjustments, as examples.

Some methods may include, for example, an act of measuring excess air in products of combustion and adjusting the air and fuel mixture ratio to compensate for variations in heating value of the fuel, for example. A number of embodiments may compensate, not just for the heating value, but also for the density of the fuel, which may affect velocity of flow through the fuel injector orifice, for instance. Certain embodiments may compensate for comprehensive or heat delivery characteristics of the fuel gas, for example. Accordingly, some methods may include, for example, an act of measuring excess air in products of combustion and adjusting the air and fuel mixture ratio to compensate for heat delivery characteristics of the fuel gas, for example.

Moreover, some embodiments may include, for example, an act of measuring excess air in products of combustion and adjusting the air and fuel mixture ratio to compensate for variations in elevation where the burner is located. Further, some embodiments may include, for example, an act of measuring at least one flame characteristic and adjusting the air and fuel mixture ratio to compensate for variations in heating value of the fuel to compensate for variations in elevation where the burner is located, or both, as examples.

In addition, or instead, some embodiments may include, for example, an act of receiving a manually input adjustment and using the manually input adjustment to adjust the air and fuel mixture ratio to compensate for variations in heating value of the fuel (or heat delivery characteristics). Further, certain embodiments may include an act of receiving a manually input adjustment and using the manually input adjustment to adjust the air and fuel mixture ratio to compensate for variations in elevation where the burner is located, for example. Further, some methods may include, for example, an act of measuring conductivity of the products of combustion, an act of measuring voltage of the burner flame, an act of measuring burner noise and adjusting the air and fuel mixture ratio to control burner noise, an act of measuring burner vibration and adjusting the air and fuel mixture ratio to control burner vibration, an act of measuring chemiluminescence, an act of measuring UV, an act of red/yellow heat sensing, an act of measuring differential rectification, or a combination thereof, as examples.

Moreover, some embodiments may include an act of measuring NOx content in the products of combustion and adjusting the air and fuel mixture ratio to control NOx production, an act of measuring CO content in the products of combustion and adjusting the air and fuel mixture ratio to control CO production, an act of measuring oxygen content in the products of combustion and adjusting the air and fuel mixture ratio to control oxygen content in the products of combustion, or a combination thereof, as further examples. In other embodiments, other ways to determine excess air may be used. In some embodiments, differential rectification, radiant heat color, etc. may be used (e.g., instead or in addition).

Some methods may include, for example, acts of forming, making, obtaining, or providing various combinations of the components listed above or described herein, as examples. Other embodiments include various furnaces having a controller that is configured (e.g., programmed or specifically made) to perform a method described herein, or wherein the controller includes, for example, software containing instructions to perform a method described herein.

Some embodiments may recirculate some of the products of combustion through the burner to reduce oxygen availability to form NOx. Further, some embodiments may preheat combustion air (e.g., approaching or after the air inlet passage), fuel (e.g., approaching or after leaving the fuel injector),or both, for example, using heat from products of combustion after the products of combustion leave the heat exchanger that transfers heat to the air that is to be delivered to the (e.g., occupied) space. Such preheating may increase efficiency, for example. Further, some embodiments may have multiple combustion chambers (e.g., one for each burner tube) or combustion may take place within the burner tubes, as other examples.

Other embodiments include a building that includes an HVAC unit, HVAC system, air conditioning unit, furnace, or an apparatus or device (e.g., for reducing NOx emissions) described herein, or an HVAC unit, HVAC system, or air conditioning unit, having an apparatus described herein, as examples. Such a building may include walls and a roof, and may form an enclosure or enclose an occupied space, for example. A building or HVAC system may include, besides an HVAC unit, supply and return air ductwork, registers, an air filter, a thermostat or controller, a load controller, a condensation drain, or a combination thereof, for example. HVAC units may include a compressor, evaporator and condenser fans, motors for the compressor and fans, a housing, wiring, controls, refrigerant tubing, an expansion valve, and the like, for instance. In different embodiments, HVAC units may be packaged units or may be split systems, as examples.

It should be noted that various methods in accordance with different embodiments include acts of selecting, making, cutting, forming, bending, positioning, installing, or using certain components, as examples. Other embodiments may include performing other of these acts on the same or different components, or may include fabricating, assembling, obtaining, providing, ordering, receiving, shipping, or selling such components, or other components described herein or known in the art, as other examples. Further, various embodiments of the subject matter described herein include various combinations of the components, features, and acts described herein or shown in the drawings, for example.

Turning now to the specific examples of embodiments illustrated in the figures, FIG. 1 illustrates an example of a premix furnace, furnace 10, for instance, for heating an occupied space. Furnace 10 may produce lower than standard NOx emissions, for instance. As used herein, "standard" NOx emissions are emissions produced by typical prior non-premix furnaces. In embodiment illustrated, furnace 10 includes air inlet passage 11, fuel injector 12, a mixing device (e.g., 21, 31, or 41 shown in FIGS. 2-4), burner plate 13, combustion chamber 14, heat exchanger tubes 15 and 16, and inducer or fan 17.

The embodiment show (e.g., in FIG. 1) includes multiple parallel heat exchanger tubes (e.g., 15 and 16) that are downstream of combustion chamber 14 for transferring heat from products of combustion, for example, to air to be delivered to the occupied space. In addition, fan 17 is located downstream of heat the exchanger tubes (e.g., 15 and 16), and draws air through air inlet passage 11, the mixing device (e.g., 21, 31, or 41 shown in FIGS. 2-4), burner plate 13, and combustion chamber 14. Further, fan 17 draws products of combustion through the heat exchanger tubes (e.g., 15 and 16).

Furnace 10 may include multiple heat exchanger tubes 15, only one of which is visible in FIG. 1 because the other heat exchanger tubes 15 are parallel to, lined up with, and hidden behind the visible heat exchanger tube 15. There may be, for example, multiple parallel heat exchanger tubes (e.g., 15, 16, or both) that are downstream of combustion chamber 14 for transferring heat from products of combustion, for example, to air to be delivered to the occupied space. There may be, for example, four heat exchanger tubes 15. Other embodiments may have 1, 2, 3, 5, 6, 7, 8, 9, 10, 11, 12, 13, 14, or 15 heat exchanger tubes 15, as other examples. In the embodiment illustrated, each heat exchanger tube 15 includes two 180 degree bends.

Although not shown in detail, heat exchanger tube 16 may further include multiple (e.g., parallel) heat exchanger tubes. In a number of embodiments, there may be more heat exchanger tubes 16 than heat exchanger tubes 15, but heat exchanger tubes 16 may be smaller in diameter. Heat exchanger tubes 16 may be housed within external fins, which may help to transfer heat from heat exchanger tubes 16 to the air that is being delivered to the occupied space. The air to be delivered to the occupied space may travel upward past heat exchanger tubes 16 first, and then past heat exchanger tubes 15.

The air to be delivered to the occupied space may be moved by a blower or indoor fan, which is not shown. The indoor fan may blow air past the heat exchanger tubes (e.g., 16 and 15) rather than drawing air past the heat exchanger tubes. Because the indoor fan blows air past the heat exchanger tubes (e.g., 16 and then 15), and the inducer or fan 17 for the products of combustion draws air through the heat exchanger tubes (e.g., 15 and then 16) the indoor air usually has a greater pressure than the products of combustion. As a result, if a breach or leak develops, for instance, in heat exchanger 15 or 16, the products of combustion do not leak into the air that is delivered to the occupied space.

In the embodiment shown, air inlet passage 11 includes, for example, inlet tube 18 having inlet end 19, and fuel injector 12 is mounted at inlet end 19 of inlet tube 18. As shown, for instance, in FIGS. 2-4, fuel injector 12 includes orifice 22 for dispensing fuel, and fuel injector 12 is oriented to dispense fuel into inlet end 19 of inlet tube 18. As shown, in this embodiment, fuel injector 12 is located partially within inlet end 19 of inlet tube 18, and orifice 22 is located within inlet end 19 of inlet tube 18. Annular space 23 between fuel injector 12 and inlet tube 18 (i.e., at inlet end 19) permits air to enter inlet tube 18 around fuel injector 12.

In number of embodiments, the mixing device (e.g., 21, 31, or 41 shown in FIGS. 2-4) or target is downstream of fuel injector 12. The mixing device (e.g., 21, 31, or 41) may mix air and fuel (e.g., dispensed from fuel injector 12) prior to combustion (e.g., in combustion chamber 14). In various embodiments, the mixing device (e.g., 21, 31, or 41 shown in FIGS. 2-4) or target may create turbulence which may promote mixing, may block or impede fuel from traveling downstream (e.g., within inlet tube 18) without mixing with air, or both, as examples. The mixing device (e.g., 21, 31, or 41) may help to produce a more homogeneous mixture of air and fuel before combustion in combustion chamber 14.

Further, burner plate 13 is located downstream of the mixing device (e.g., 21, 31, or 41), and, when furnace 10 is in operation, burner plate 13 separates unburned air and fuel mixture on upstream side 131 of burner plate 13 from burning air and fuel and products of combustion on downstream side 132 of burner plate 13. FIGS. 5-8 and 15 illustrate, among other things, burner plate 13 in more detail. Burner plate 13 includes, for example, multiple ports 63 therethrough. In the embodiment illustrated, air and fuel mixture pass through ports 63 in burner plate 13. In the embodiment illustrated, cross over ports are not provided between the rectangular shapes (e.g., shown in FIGS. 6 and 7) formed by ports 63. In other embodiments, however, cross over ports may be provided between shapes to help the flame propagate between the shapes.

Still further, combustion chamber 14 is located downstream of burner plate 13, and is defined on an upstream side by burner plate 13. During operation of furnace 10, the air and fuel mixture ignites when it passes through ports 63 into combustion chamber 14. In normal operation of furnace 10, adequate velocity exists through ports 63 to prevent the constant combustion within combustion chamber 14 from propagating through ports 63 to ignite the air and fuel mixture within inlet tube 18. As described above, in some embodiments, particular arrangement of ports 63 may be provided to obtain desired performance from furnace 10.

Figure 5:
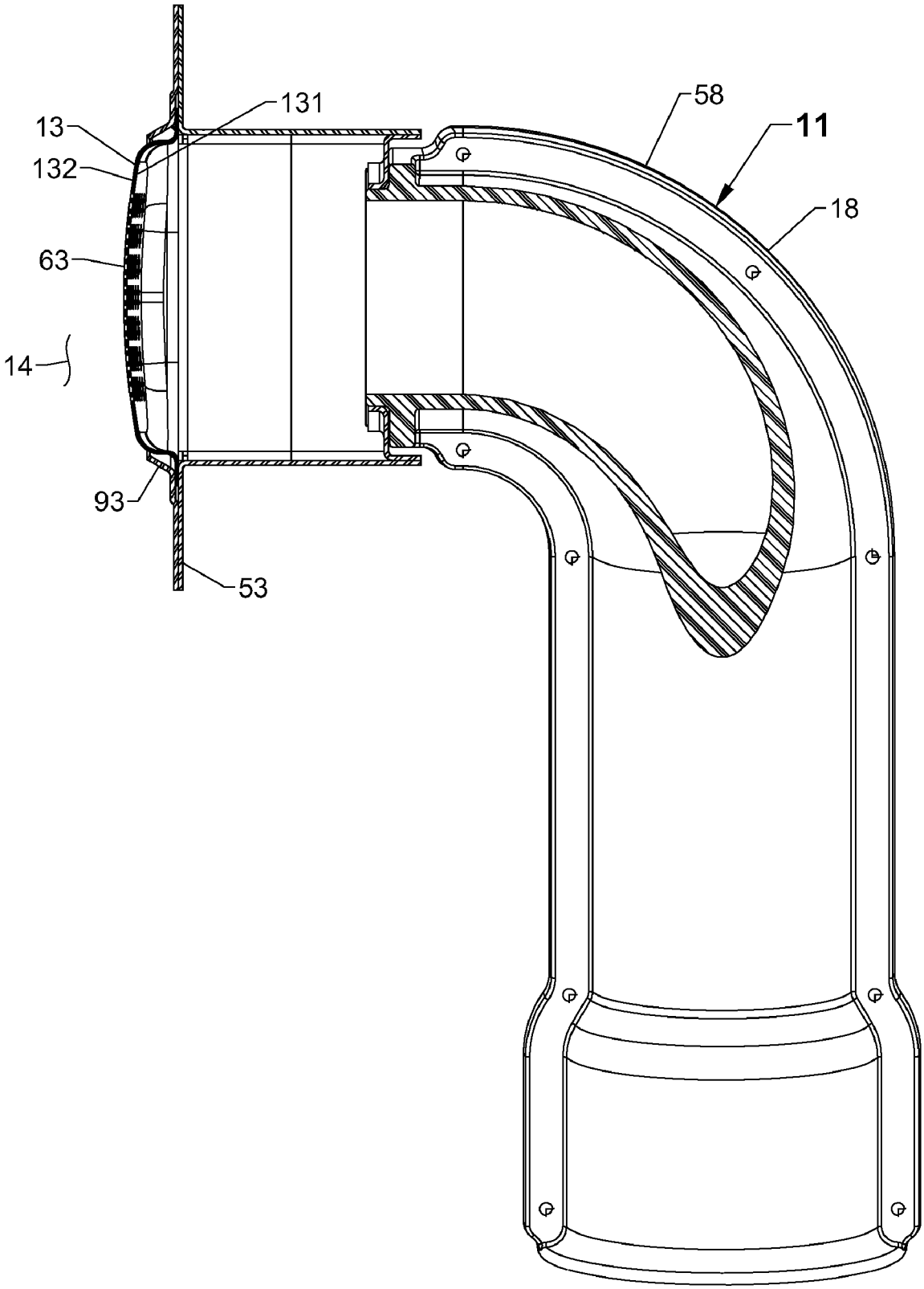
FIG. 5 is a cross sectional side view (opposite side from FIG. 1) of the inlet tube and burner plate of FIG. 1 (and potentially of any of FIGS. 2-4)
Figure 8:
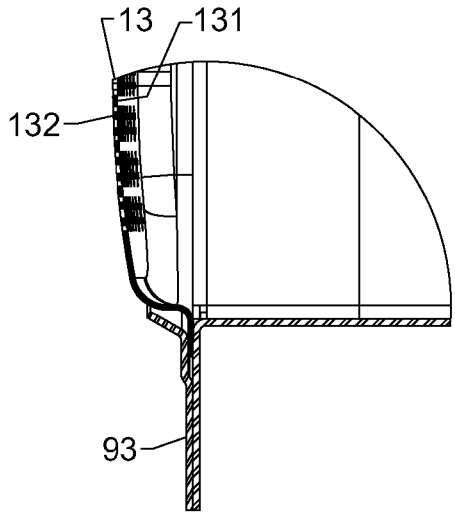
FIG. 8 is a detail cross sectional side view (part of FIG. 5) illustrating the attachment of the burner plate to the air inlet passage.
Figure 9:
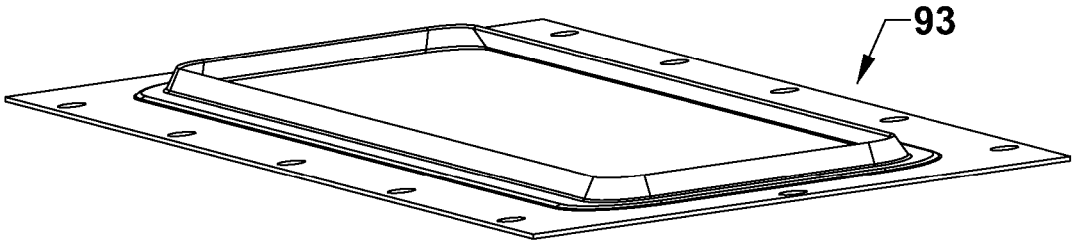
FIG. 9 is an isometric view of a downstream flange that supports the burner plate.

As shown in FIGS. 5 and 8, burner plate 13 is attached (e.g., to air inlet passage 11, or to a mixing chamber or burner body, for instance, at the end of inlet passage 11, or to combustion chamber 14) by being sandwiched between opposing surfaces (e.g., of flanges 53 and 93), so that burner plate 13 slides against the opposing surfaces when burner plate 13 expands and contracts, for instance, due to temperature changes as furnace 10 cycles on and off. This way of mounting burner plate 13 may reduce stress and fatigue of burner plate 13 as burner plate 13 expands and contracts due to the heat of combustion and the cycling on and off of furnace 10. In some embodiments, close tolerances may be provided around burner plate 13 to avoid air and fuel from leaking around burner plate 13 into combustion chamber 14 without traveling through ports 63. In certain embodiments, a gasket may be used to avoid or reduce air and fuel from leaking around burner plate 13 into combustion chamber 14 without traveling through ports 63. In some embodiments, however, a certain amount of such leakage may be acceptable.

Further, in the embodiment illustrated, burner plate 13 is curved. Specifically, in the embodiment shown, upstream side 131 of burner plate 13 is concave and downstream side 132 of burner plate 13 is convex. This shape may also reduce stress and fatigue, for example, resulting from temperatures changes and resulting expansion and contraction. In the embodiment illustrated, burner plate 13 is curved in two dimensions. In other embodiments, the burner plate may be curved in just one dimension (e.g., in some embodiments the burner plate may include all or part of a circular cylinder).

Figure 2:
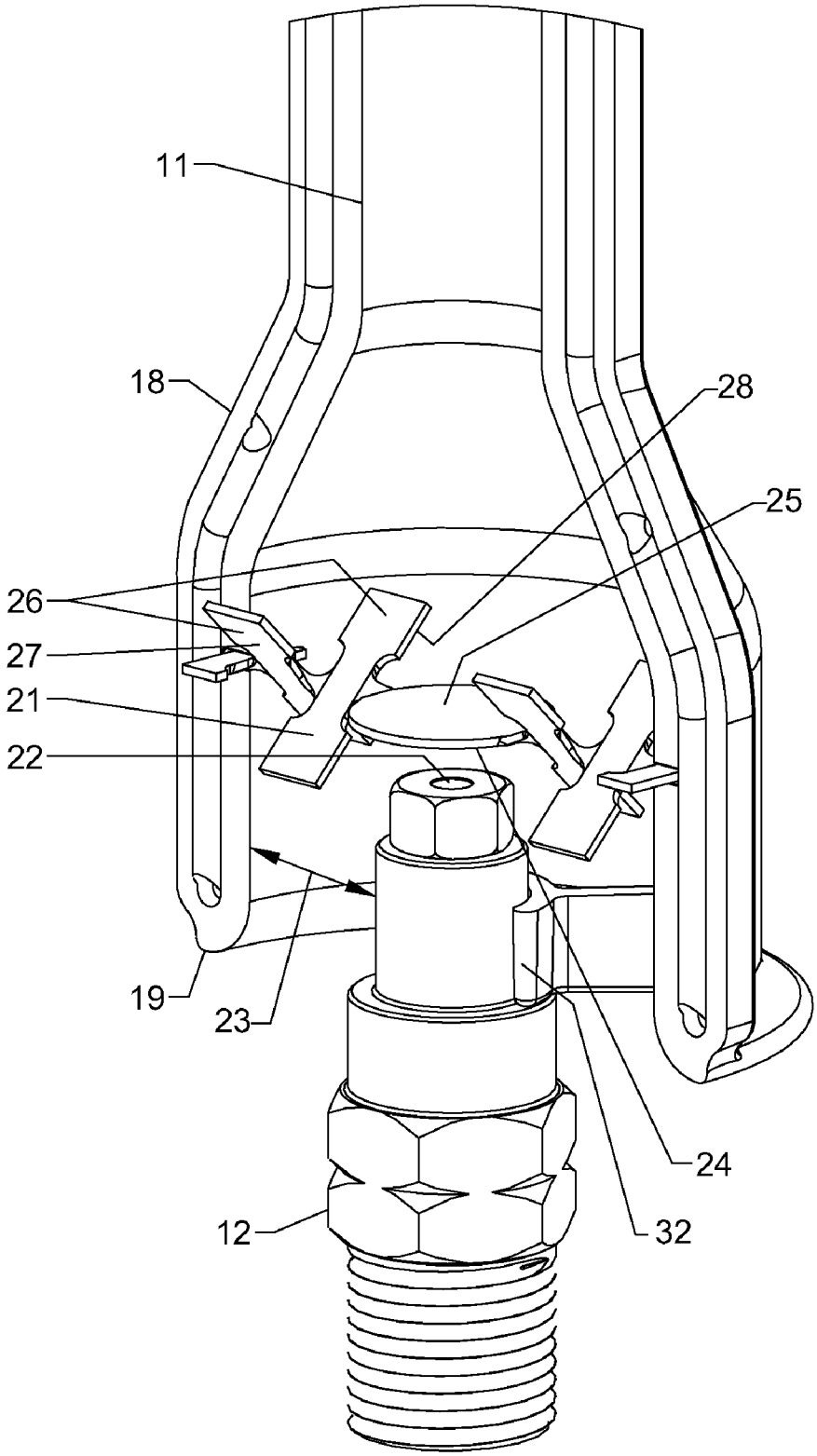
FIG. 2 is a partial isometric view of an inlet end of an inlet tube that forms an air inlet passage for a premix burner of a furnace, for example, and also showing a fuel injector mounted in the inlet end and a mixing device downstream of the fuel injector for swirling and mixing the air and fuel prior to combustion.
Figure 3:
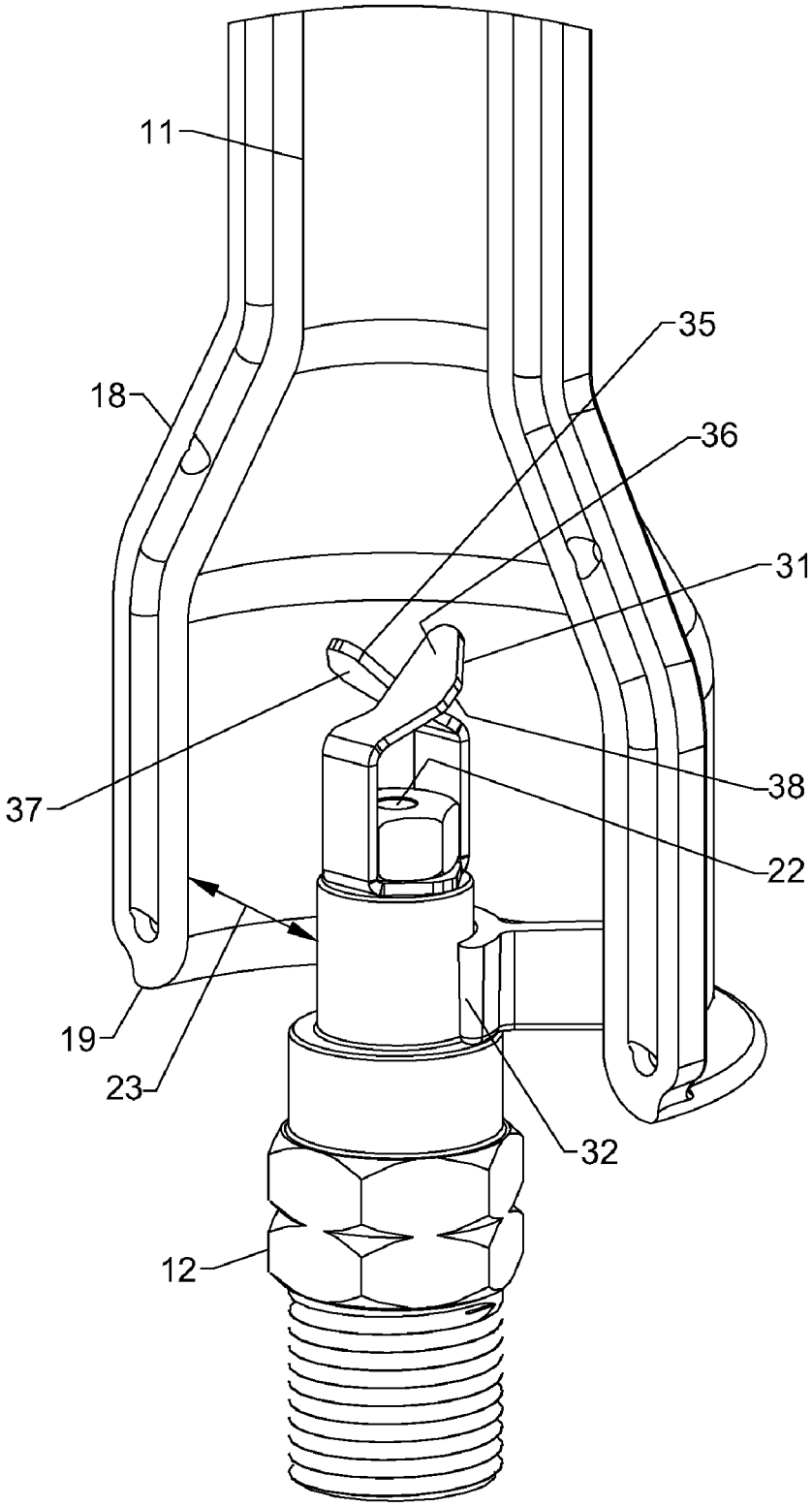
FIG. 3 is a partial isometric view of an inlet end of an inlet tube that forms an air inlet passage for a premix burner of a furnace, for example, and also showing a fuel injector mounted in the inlet end, and showing a different embodiment of a mixing device downstream of the fuel injector for swirling and mixing the air and fuel prior to combustion, this mixing device being attached to the fuel injector.
Figure 4:
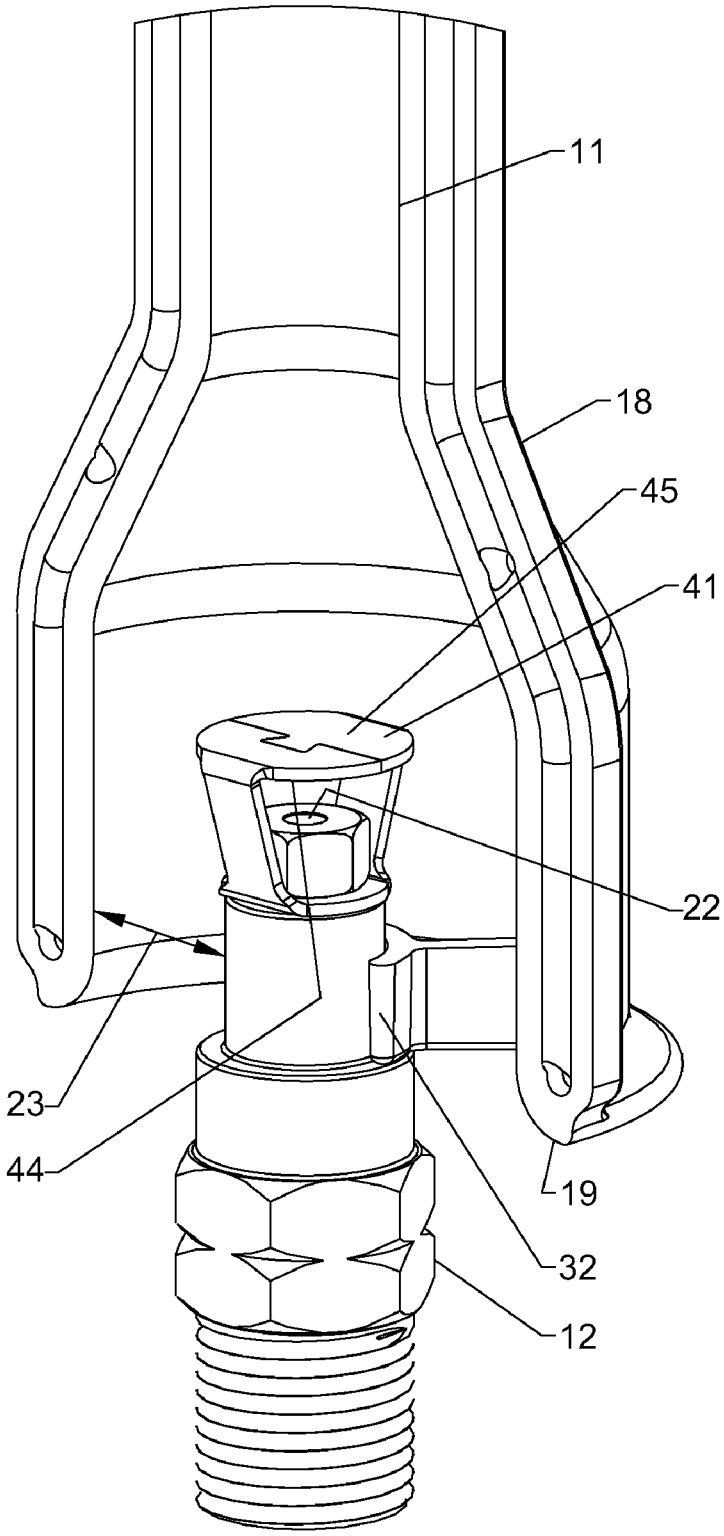
FIG. 4 is a partial isometric view of an inlet end of an inlet tube that forms an air inlet passage for a premix burner of a furnace, for example, and also showing a fuel injector mounted in the inlet end, and showing yet a different embodiment of a mixing device downstream of the fuel injector for mixing the air and fuel prior to combustion, this mixing device also being attached to the fuel injector.

As shown in FIGS. 2-4, in certain embodiments, the mixing device (e.g., 21, 31, or 41) is located inside air inlet tube 18 (e.g., within inlet end 19). As shown in FIGS. 2 and 4, in some embodiments, the target or mixing device (e.g., 21 or 41) includes a (e.g., flat) surface (e.g., 24 or 44) that is substantially perpendicular to the direction of fuel flow exiting fuel injector 12 and that is located in front of orifice 22 of fuel injector 12. As used herein, "substantially perpendicular" means perpendicular to within 10 degrees. Further, as used herein the "direction of fuel flow" is the average direction of fuel flow (e.g., emerging from orifice 22). Even further, as used herein, "in front of the orifice" means that most of the fuel exiting the orifice impacts with or has its direction of flow substantially changed by the surface.

Figure 12:
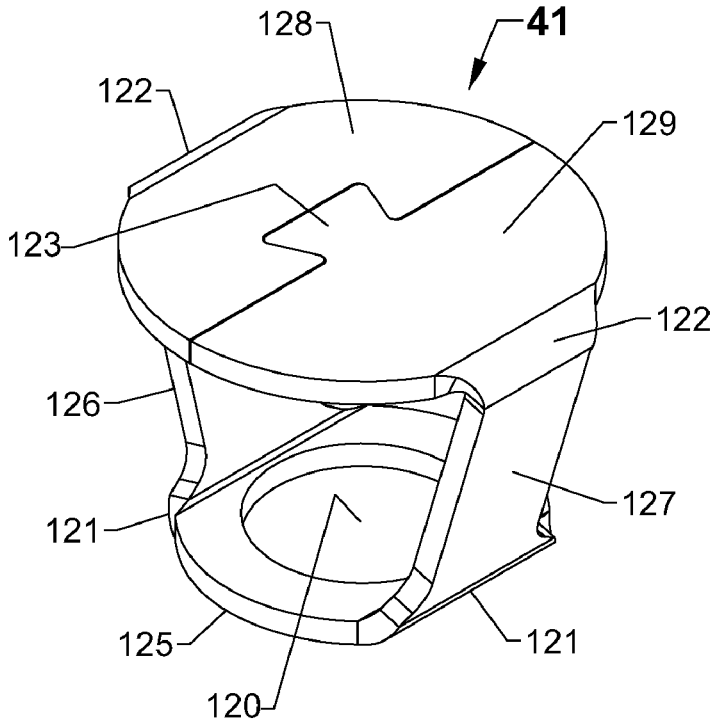
FIG. 12 is a detail isometric view of the mixing device shown in FIG. 4.
Figure 13:
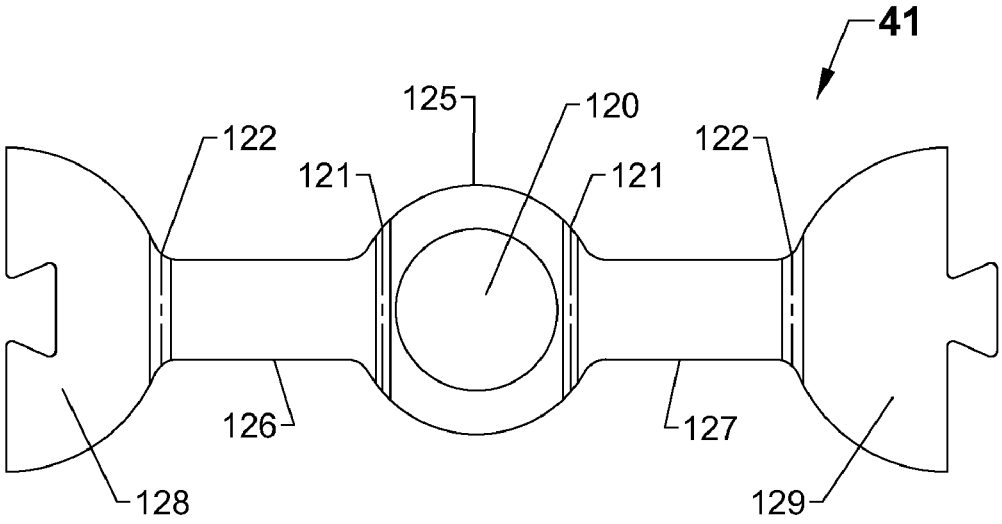
FIG. 13 is a flat pattern of the mixing device of FIGS. 4 and 12.

In the embodiment shown in FIGS. 4, 12, and 13, (e.g., flat) surface 44 is made up of ends 128 and 129 that are attached to each other with dovetail joint 123. Ends 128 and 129 are each substantially a semicircle, in this embodiment (e.g., except for dovetail joint 123), which when attached, substantially form a circle that establishes flat surface 44. Further, surface 44 is substantially a circle, in this embodiment. In the embodiment shown in FIG. 2, (e.g., flat) surface 24 is also substantially a circle. As used herein, "substantially a circle" means a circle except for attachment points, for example, referring to mixing device 41, except where bends 122 are formed or where arms 126 and 127 attach. In various embodiments, the target or surface (e.g., analogous to 24 or 44) may have a diameter that is between 0.5 inches and 1.5 inches, between 0.75 and 1.0 inches, about 0.813 inches, or about 20.6 mm, as examples. In other embodiments, the target or surface (e.g., analogous to 24 or 44) may have the shape of a polygon, square, rectangle, hexagon, or octagon, as other examples.

In number of embodiments, the mixing device (e.g., 21, 31, or 41 shown in FIGS. 2-4) includes, for instance, at least one (e.g., flat) metal plate (e.g., 25, 26, 35, 36, or 45) that is located downstream of orifice 22 of fuel injector 12. In particular embodiments, the mixing device (e.g., 31 shown in FIG. 3) includes, for instance, two surfaces (e.g., 27 and 28 shown in FIG. 2 or 37 and 38 shown in FIG. 3), for instance, at inlet end 19, that are held, for example, at substantially opposite angles (e.g., as shown) so as to induce swirl in inlet tube 18. As used herein, "substantially opposite angles", at least in this context, means that the angle between each of the two surfaces and the direction of flow (e.g., the direction of fuel flow exiting fuel injector 12) are equal, to within 10 degrees, but that these angles are 180 degrees (plus or minus 10 degrees) apart from each other (around the direction of flow, for example, the direction of fuel flow exiting fuel injector 12).

In various embodiments, the angle between each of the two surfaces and the direction of flow (e.g., the direction of fuel flow exiting fuel injector 12) may be, for example, 10, 15, 20, 25, 30, 35, 40, 45, 50, 55, 60, 65, 70, or 80 degrees, or about such an angle, as examples. As used herein, "about", when referring to an angle, means plus or minus 5 degrees. In a number of embodiments, the angle between each of the two surfaces and the direction of flow (e.g., the direction of fuel flow exiting fuel injector 12) may be between 25 and 65 degrees between 30 and 60 degrees, between 35 and 55 degrees, between 40 and 50 degrees, or about 45 degrees, as examples.

In some embodiments, the mixing device (e.g., 21 or 31 shown in FIGS. 2-3) includes, for instance, two surfaces (e.g., 27 and 28 shown in FIG. 2 or 37 and 38 shown in FIG. 3) that are located downstream of orifice 22 of fuel injector 12 that are held at substantially opposite angles (e.g., as shown) inducing swirl in fuel being dispensed from orifice 22 of fuel injector 12 and inducing swirl in incoming air. In a number of embodiments, such swirl promotes mixing of the two flows (e.g., of air and fuel). In different embodiments, these two surfaces may be flat (e.g., 27 and 28 shown in FIG. 2 or 37 and 38 shown in FIG. 3), or may be curved, as examples. As used herein, flat, when referring to a surface or plane, means flat to within 10 percent of a length of the surface or plane.

Further, in various embodiments, the mixing device (e.g., 31 or 41 shown in FIGS. 3-4) is attached to fuel injector 12. As used herein, being "attached to" the fuel injector means that the mixing device is mounted on the fuel injector rather than being mounted on the inlet tube (e.g., 18, for example, as shown for mixing device 21 in FIG. 2). In some embodiments, there may be one or more other structural components, however, between the mixing device and the fuel injector. In various embodiments, mounting the mixing device on the fuel injector (e.g., mixing devices 31 or 41 shown in FIGS. 3-4, mounted to fuel injector 12) may provide for better or more consistent alignment between the mixing device and the orifice (e.g., 22) or fuel injector (e.g., 12).

Figure 10:
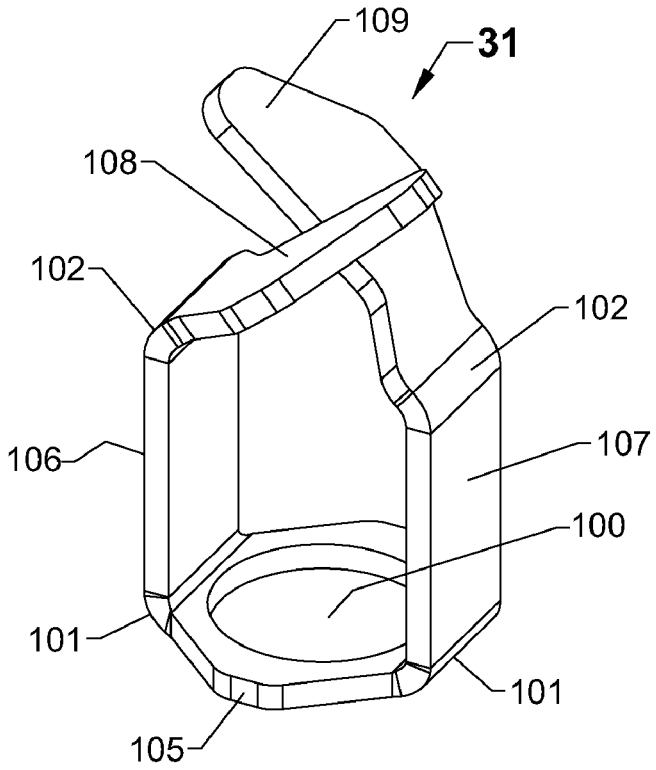
FIG. 10 is a detail isometric view of the mixing device shown in FIG. 3.
Figure 11:
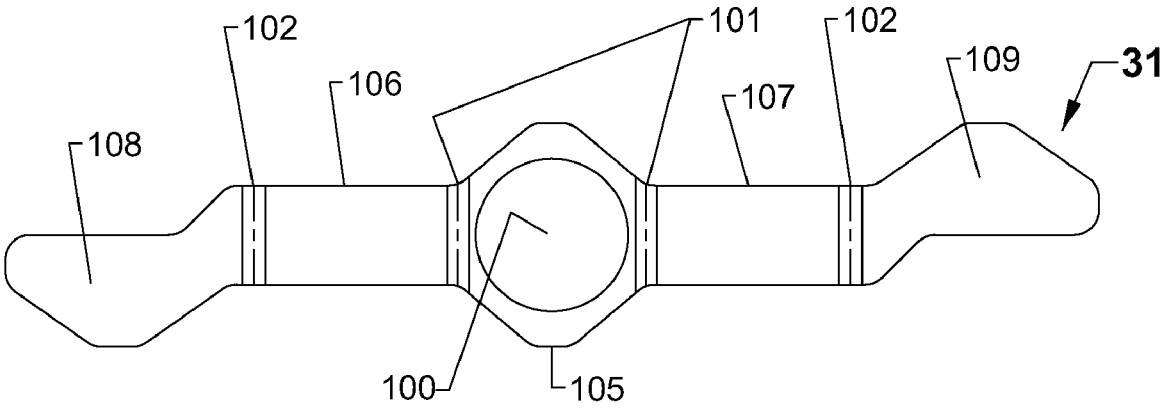
FIG. 11 is a flat pattern of the mixing device of FIGS. 3 and 10.

In the embodiment illustrated, the mixing device (e.g., 21, 31, or 41 shown in FIGS. 2-4) includes, or is made of, a piece of sheet metal. Some embodiments may be made from, for example, 18 gauge, 0.047-inch, or 1.2 mm thick stainless steel (e.g., austenitic stainless steel). Other embodiments may use 14, 16, 20, or 22 gauge stainless steel, as other examples. Other alternative materials include aluminized steel, galvanized steel, carbon steel, aluminum, copper, and nickel. Mixing device 31, introduced in FIG. 3, is shown in more detail in FIGS. 10-11 and mixing device 41 introduced in FIG. 4 is shown in more detail in FIGS. 12-13. In the embodiments shown, these mixing devices (e.g., 31 and 41) include multiple bends (e.g., 101 and 102 or 121 and 122 shown in FIGS. 10-13). In particular embodiments, the piece of sheet metal (e.g., mixing device 31 or 41) includes, for instance, a center (e.g., 105 or 125), which may have a hole (e.g., 100 or 120), for example, that attaches, or may be used to attach, the piece of sheet metal (e.g., mixing device 31 or 41) to fuel injector 12.

Hole 100 or 120 may have a diameter of about 0.384 inches, about 9.8 mm, about 0.405 inches, or about 10.3 mm, as examples. Further, in various embodiments, surface 24 or 44 may be ¼ to 2 inches from fuel injector 12 or from orifice 22. In particular embodiments, for example, surface 24 or 44 may be ½ to 1 inches from fuel injector 12 or from orifice 22. In certain embodiments, for example, surface 24 or 44 may be about 0.265 inches or 6.7 mm from fuel injector 12 or from orifice 22.

In the embodiments shown in FIGS. 3, 4, and 10-13, the piece of sheet metal (e.g., mixing device 31 or 41) includes, for instance, two arms (e.g., 106 and 107 or 126 and 127 shown in FIGS. 10-13) extending from the center (e.g., 105 or 125) to two ends (e.g., 108 and 109 or 128 and 129), for example, each located in front of orifice 22 of fuel injector 12 (e.g., as shown in FIGS. 3 and 4). In a number of embodiments, each arm (e.g., 106 and 107 or 126 and 127) may have a width of about 0.25 inches or about 6.4 mm, for example. In these embodiments, each arm (e.g., 106 and 107 or 126 and 127 shown in FIGS. 10-13) is separated from the center (e.g., 105 or 125) by a first bend (e.g., 101 or 121), and each end (e.g., 108 and 109 or 128 and 129) is separated from one of arms (e.g., 106 and 107 or 126 and 127) by a second bend (e.g., 102 or 122), for example.

In the embodiments shown, bends 101 have an angle of about 90 degrees, and bends 121 have an angle (from straight) of about 74 degrees. Other embodiments may have an analogous angle (from straight) of about 45, 50, 55, 60, 65, 70, 75, 80, 85, or 95 degrees, as other examples. In addition, in the embodiments shown, bends 102 have an angle of about 50 degrees, and bends 122 have an angle (from straight) of about 107 degrees. Other embodiments may have an analogous angle (from straight) of about 20, 25, 30, 35, 40, 45, 55, 60, 65, 70, 75, 80, 85, 95, 100, 105, 106, 110, 115, 120, 125, 130, 135, 140, or 150 degrees, as other examples.

Once installed on fuel injector 12, in some embodiments, these mixing devices (e.g., 31) may not extend outside of a particular circle diameter. Otherwise the mixing device cannot be inserted into mount 32 within burner tube 18 with the mixing device attached to the fuel injector. In the embodiment illustrated, this particular circle diameter is 0.600 inches, or 15.2 mm, for example. Mixing device 41, however, has a larger diameter, and mixing device 41 may be attached to fuel injector 12 after fuel injector 12 is attached to mount 32 of inlet tube 18. Other embodiments may have a different type of mount between the fuel injector and inlet tube that may permit a mixing device of the size of mixing device 41 to be attached to the fuel injector first before installing the fuel injector.

Figure 14:
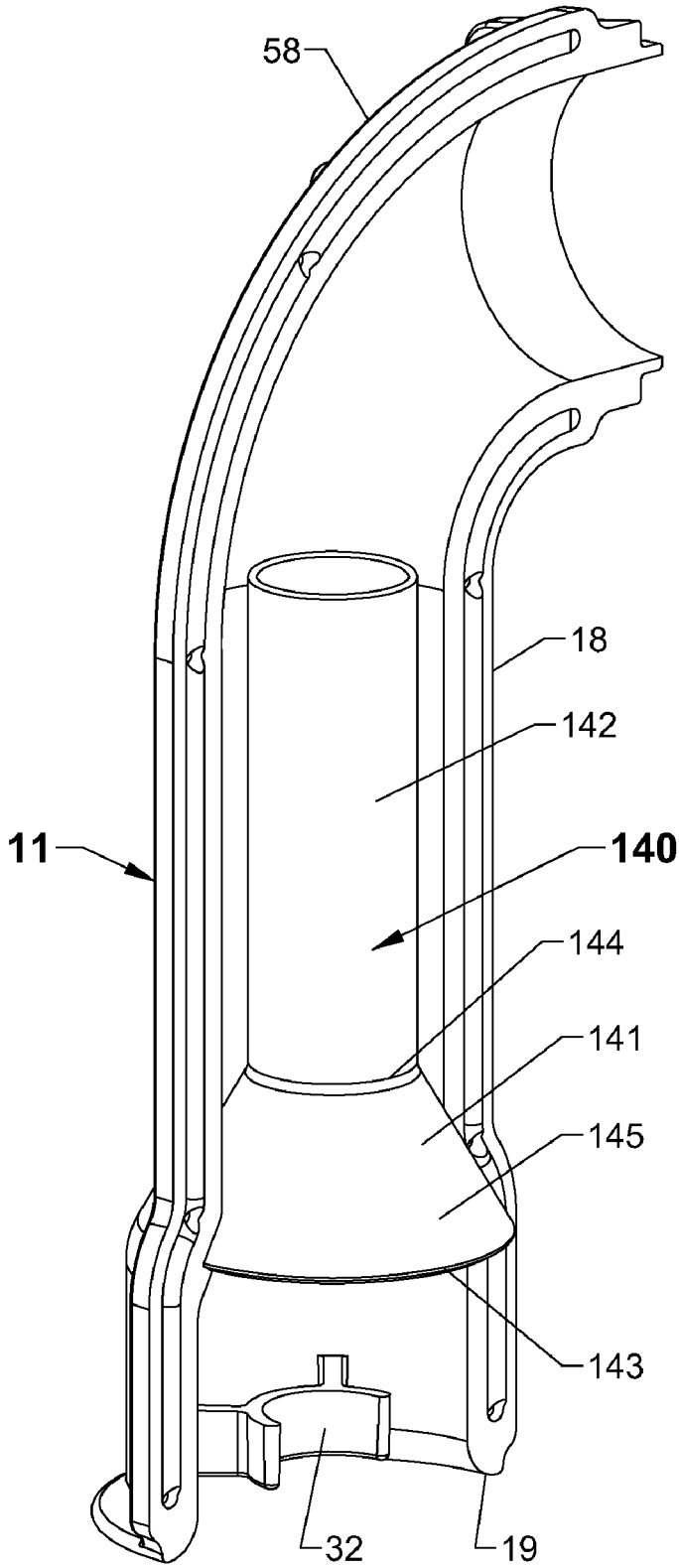
FIG. 14 is an isometric view of an inlet tube (e.g., of FIG. 1), illustrating, among other things, a fluidic diode located within the inlet tube.

FIG. 14 illustrates that, in number of embodiments, a fluidic diode (e.g., fluidic diode 140) may be located inside inlet tube 18. As used herein, a "fluidic diode" is device that, without moving parts, at least at a particular flow rate, provides more pressure drop for flow in one direction than in an opposite direction. In the embodiment illustrated, fluidic diode 140 is oriented to provide greater restriction to backflow than to forward flow, for example. (As used herein, "forward flow" is flow from fuel injector 12 to combustion chamber 14.) In the embodiment shown, fluidic diode 140 includes, for instance, hollow frustum or frustoconical portion 141. In various embodiments, hollow frustum or frustoconical portion 141 may have walls 145 at an angle of about 30 degrees from the centerline of inlet tube 18. In other embodiments, hollow frustum or frustoconical portion 141 may have walls 145 at an angle of about 15, 20, 25, 35, 40, 45, or 50 degrees from the centerline of inlet tube 18, as other examples.

In the embodiment depicted, hollow frustum or frustoconical portion 141 includes, for example, larger opening 143 and smaller opening 144. In the embodiment shown, larger opening 143 and smaller opening 144 are both circular. In some embodiments, larger (e.g., circular) opening 143 may have a diameter of about 2 9/64 inches (OD) and smaller (e.g., circular) opening 144 may have a diameter of about 1 13/64 inches or about 29/32 inches (ID) as examples. As illustrated, in this particular embodiment, larger opening 143 is closer to fuel injector 12 than smaller opening 144.

In the embodiment shown, fluidic diode 140 further includes, for instance, (e.g., circular) cylinder 142 extending, for example, from smaller opening 144 away from fuel injector 12. In the embodiment shown, cylinder 142 is attached to smaller opening 144. In some embodiments, cylinder 142 may have a diameter of about 1 13/64 inches or about 29/32 inches (ID), as examples, and may be about 3 inches long. In other embodiments, cylinder 142 may be about 1, 1.5, 2, 2.5, 2.75, 3.25, 3.5, 4, 4.5, 5, or 6 inches long, as other examples In the embodiment illustrated, cylinder 142 is substantially concentric with inlet tube 18, for example. Other embodiments may lack a cylinder, or may include a cylinder that is not concentric. Other embodiments may have a cross section or openings other than circular, such as polygonal, square, rectangular, triangular, pentagonal, hexagonal, octagonal, or oval, as examples.

In a number of embodiments, a burner or furnace may include a separate mixing device (e.g., 21, 31, or 41) and fluidic diode (e.g., 140). A fluidic diode, however, may promote mixing by itself. In fact, in some embodiments, a fluidic diode may be used that may produce sufficient mixing that a separate mixing device is not needed. An example is a hollow cone mounted within the inlet tube (e.g., 18) downstream of the fuel injector (e.g., 12) with the point of the cone in front of the orifice (e.g., 22) of the fuel injector and the open base of the cone pointed downstream or toward the burner plate (e.g., 13). In various embodiments, such a cone may be concentric or substantially concentric with the inlet tube, for instance. In some embodiments, vanes may extend from the cone to the inside of the inlet tube. The vanes may be angled, in some embodiments, to produce swirl in the inlet tube downstream of the cone, for example, to promote mixing of the air and fuel.

In other embodiments, a cup or hollow pyramid with an open base may be used instead of a cone, with the point of the pyramid or convex surface of the cup facing upstream toward the orifice of the fuel injector and the open base of the pyramid or concave surface of the cup facing downstream. Such a pyramid may have 3, 4, 5, 6, 7, or 8 sides, as examples, may have a polygonal cross section, or both, for instance. Such a cup may be part of a hollow sphere, such as a hollow hemisphere, or may be a hollow parabola, as examples. In various embodiments, however, the mixing device may provide the most benefit close to the fuel injector, while the fluidic diode may provide more benefit closer to the burner plate. Further, in some embodiments, the mixing device may be a fluidic diode, and another fluidic diode may be provided further downstream. In some such embodiments, both such fluidic diodes may be oriented to provide greater restriction to backflow than to forward flow.

As shown in FIGS. 1, 5, 6, and 14, inlet tube 18, in the embodiment illustrated, includes bend 58. In various embodiments such a bend (e.g., 58) may have an angle between 22.5 and 135 degrees, for example. Other examples of angles are identified herein. In the embodiment illustrated, bend 58 has an angle of about 90 degrees, for example. Other embodiments may not have a bend, or may have more than one bend. One or more bends (e.g., 58) may help to promote mixing of the air and fuel, may impact oscillations or noise, or a combination thereof.

Figure 15:
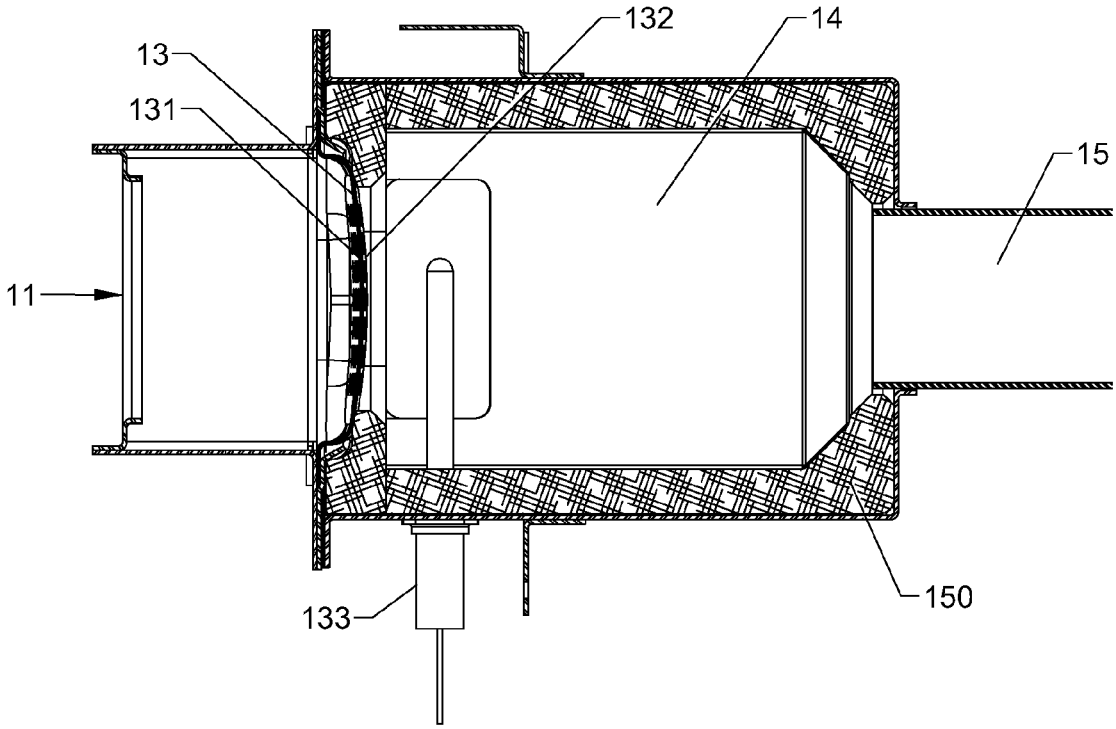
FIG. 15 is a detail cross-sectional side view of a combustion chamber and burner plate shown with a refractory material lining the combustion chamber.

As shown in FIG. 15, in some embodiments, combustion chamber 14 is lined with refractory insulation 150. In particular embodiments, however, such as in the embodiment shown, refractory insulation 150 may be omitted from at least one portion of the combustion chamber 14 (e.g., that includes ports 63). Refractory material or insulation 150 may keep the outside of combustion chamber 14 cooler, which may reduce stress and fatigue or may keep neighboring components cooler. In some embodiments, refractory insulation 150 may also help to dampen oscillations or noise.

In some embodiments, a refractory shield may be formed over the un-ported surfaces of the burner plate (e.g., 13), which may be done specifically to reduce the temperature of the burner plate and thus reduce oxidation and stress of the burner plate. This may provide a successful perforated steel burner in a radiant refractory combustion chamber (e.g., 14). Certain embodiments include (e.g., in combination with the refractory insulation 150 shown), a port field arrangement that offers greater shielding. For example, in some embodiments, port groups (e.g., the rectangular shapes of ports 63 shown) may be arranged in continuous side-to-side rows, leaving adjacent bare surfaces that may be more-effectively shielded (e.g., with refractory insulation such as 150).

FIG. 15 also illustrates igniter or sensor 133 within combustion chamber 14. Various examples of igniters and sensors are described herein, for example.

As shown in schematic form in FIG. 1, in some embodiments, furnace 10 includes, for example, adjustment input mechanism 190, for instance, to adjust air/fuel ratio or excess air. Furnace 10 also includes, in the embodiment illustrated, controller 195. Controller 195 includes, in this embodiment, digital processor 196. In various embodiments, controller 195 may receive input from adjustment input mechanism 190 and may be in control of (e.g., at least one of) fuel injector 12, a gas regulator, an air damper, or fan 17, as examples, and may control (e.g., at least one of) fuel delivery rate or air flow rate (e.g., through air inlet passage 11), as examples. In a number of embodiments, controller 195 may control combustion stoichiometry, for instance, using input from adjustment input mechanism 190.

In particular embodiments, for example, adjustment input mechanism 190 may be or include a user interface, such as a keypad, touch screen, set of switches (e.g., dip switches), knob, or a combination thereof. In certain embodiments, for example, adjustment input mechanism 190 may include a screen or display. Further, in some embodiments, adjustment input mechanism 190 may be a plug or receptacle and a user, installer, or service person may plug in a device such as a computer, diagnostic tool, control mechanism, or the like.

In particular embodiments, for example, adjustment input mechanism 190 may receive input of elevation, and controller 195 may use the input of elevation to adjust the air/fuel ratio or excess air, for example, to account for elevation of installation of furnace 10. for instance, input mechanism 190 may receive input of elevation from an installer, a user, a distributer, or from the manufacturer, as examples. Further, in some embodiments, adjustment input mechanism 190 may be configured (e.g., programmed) to receive input of heat delivery characteristics of the fuel gas, for instance, and controller 195 may be configured (e.g., programmed) to use the input of heat delivery characteristics of the fuel gas to adjust the air/fuel ratio or excess air, for instance, to account for heat delivery characteristics of the fuel gas delivered to furnace 10.

Figure 16:
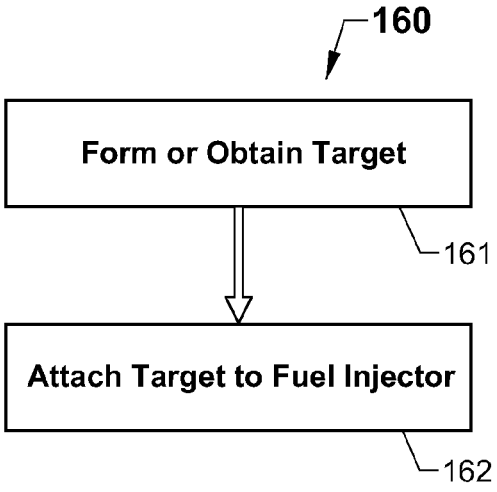
FIG. 16 is a flow chart illustrating an example of a method of mixing air and fuel delivered to a premix burner (e.g., of a furnace)

Other specific embodiments include various methods concerning premix burners or premix furnaces (e.g., furnace 10 shown in FIG. 1). Examples include a number of methods of mixing air and fuel delivered to a premix burner, for example, of furnace 10 for heating an occupied space. FIG. 16 illustrates an example of such a method, method 160, that includes, for example, at least act 161 of forming or obtaining a target, and act 162 of attaching the target to a fuel injector. For instance, act 161 of forming or obtaining a target may include forming or obtaining a mixing device (e.g., 31 or 41), which may be or include a piece of sheet metal. Further, act 162 of attaching the target may include attaching the mixing device (e.g., 31 or 41) or piece of sheet metal, for instance, specifically to fuel injector 12 of the premix burner (e.g., of furnace 10). In act 162, the mixing device (e.g., 31 or 41) or piece of sheet metal may have multiple bends (e.g., 101 and 102 or 121 and 122), for example, or the act of forming the piece of sheet metal may specifically include bending the sheet metal. Further, in a number of embodiments, act 162 of attaching the mixing device or piece of sheet metal (e.g., 31 or 41) to the fuel injector (e.g., 12) of the premix burner (e.g., of furnace 10) includes attaching the piece of sheet metal so that at least portion of piece of sheet metal (e.g., end 108, 109, 128, 129, or a combination thereof) extends over the downstream side of the orifice (e.g., 22) of the fuel injector (e.g., 12) that dispenses fuel.

Figure 17:
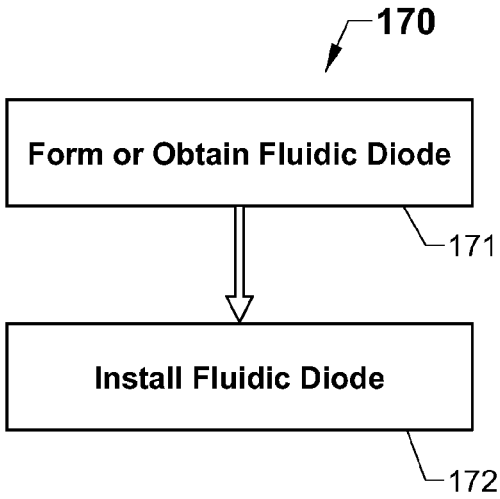
FIG. 17 is a flow chart illustrating an example of a method of improving combustion stability a premix burner (e.g., of a furnace).

Moreover, other embodiments include various methods of improving combustion stability in a premix burner, for example, of a furnace (e.g., 10) for heating occupied space. For instance, FIG. 17 illustrates method 170 that includes, for example, at least act 171 of forming or obtaining a fluidic diode (e.g., 140 shown in FIG. 14), and act 172 of installing the fluidic diode, for example, in inlet tube 18 of the premix burner (e.g., furnace 10). Fluidic diode 140 may be installed in inlet tube 18 between fuel injector 12 and combustion chamber 14, for example (e.g., between inlet end 19 and burner plate 13). Further, in various embodiments, the fluidic diode (e.g., 140) may be oriented, for example, to provide greater restriction to backflow than to forward flow (e.g., as shown).

Various embodiments of the subject matter described herein include various combinations of the acts, structure, components, and features described herein, shown in the drawings, or known in the art. Moreover, certain procedures may include acts such as obtaining or providing various structural components described herein, obtaining or providing components that perform functions described herein. Furthermore, various embodiments include advertising and selling products that perform functions described herein, that contain structure described herein, or that include instructions to perform functions described herein, as examples. Such products may be obtained or provided through distributors, dealers, or over the Internet, for instance. The subject matter described herein also includes various means for accomplishing the various functions or acts described herein or apparent from the structure and acts described.

What is claimed is:

1. A furnace for heating an occupied space while producing lower than standard NOx emissions, the furnace comprising:

an air inlet passage comprising an inlet tube having an inlet end;

a fuel injector mounted at the inlet end of the inlet tube, the fuel injector comprising an orifice that dispenses the fuel, wherein the fuel injector is oriented so that the fuel injector dispenses the fuel into the inlet end of the inlet tube, and wherein space between the fuel injector and the inlet tube permits air to enter the inlet tube around the fuel injector;

a mixing device downstream of the fuel injector that mixes the air and fuel prior to combustion, wherein the mixing device is in addition to the inlet tube, the mixing device is located inside the inlet tube, and the mixing device is attached to the fuel injector;

a burner plate downstream of the mixing device separating unburned air and fuel mixture on an upstream side of the burner plate from burning air and fuel and products of combustion on a downstream side of the burner plate, the burner plate comprising multiple ports therethrough that the air and fuel mixture pass through;

a combustion chamber downstream of the burner plate and defined on an upstream side by the burner plate;

multiple parallel heat exchanger tubes downstream of the combustion chamber that transfer heat from the products of combustion to air to be delivered to the occupied space; and a fan downstream of the heat exchanger tubes that draws air through the air inlet passage, mixing device, burner plate and combustion chamber, and that draws products of combustion through the heat exchanger tubes.

2. The furnace of claim 1 wherein the mixing device comprises a surface that is substantially perpendicular to the direction of fuel flow exiting the injector and that is located in front of the orifice of the fuel injector.

3. The furnace of claim 1 wherein the mixing device comprises two surfaces at the inlet end that are held at substantially opposite angles so as to induce swirl in the inlet tube.

4. The furnace of claim 1 wherein the mixing device comprises two surfaces that are located downstream of the orifice of the fuel injector that are held at substantially opposite angles inducing swirl in the fuel being dispensed from the orifice of the fuel injector and inducing swirl in the incoming air, whereby mixing of the two flows is promoted.

5. The furnace of claim 1 wherein the mixing device comprises a piece of sheet metal comprising multiple bends.

6. The furnace of claim 5 wherein the piece of sheet metal comprises a hole that attaches the piece of sheet metal to the fuel injector.

7. The furnace of claim 6 wherein the piece of sheet metal comprises a center and two arms extending from the center to two ends, wherein each arm is separated from the center by a first bend, and wherein each end is separated from one of the arms by a second bend.

8. The furnace of claim 1 wherein a fluidic diode is located inside the inlet tube and the fluidic diode is oriented to provide greater restriction to backflow than to forward flow.

9. The furnace of claim 8 wherein the fluidic diode comprises a hollow frustum.

10. The furnace of claim 8 wherein the fluidic diode comprises a frustoconical portion comprising a larger circular opening and a smaller circular opening, wherein the larger circular opening is closer to the fuel injector than the smaller circular opening.

11. The furnace of claim 10 wherein the fluidic diode further comprises a circular cylinder extending from the smaller circular opening away from the fuel injector, wherein the circular cylinder is substantially concentric with the inlet tube.

12. The furnace of claim 1 wherein the combustion chamber is lined with refractory insulation.

13. The furnace of claim 12 wherein the refractory insulation is omitted from at least one portion of the combustion chamber that includes the ports.

14. The furnace of claim 1 wherein the inlet tube comprises a bend between 22.5 and 135 degrees.

15. The furnace of claim 1 further comprising:

an adjustment input mechanism to adjust air/fuel ratio or excess air; and a controller comprising a digital processor, the controller receiving input from the adjustment input mechanism and in control of at least one of the fuel injector, a gas regulator, an air damper, or the fan, and controlling at least one of a fuel delivery rate or an air flow rate through the air inlet passage, wherein the controller controls combustion stoichiometry using input from the adjustment input mechanism.

16. The furnace of claim 15 wherein the adjustment input mechanism receives an input of elevation, and wherein the controller uses the input of elevation to adjust the air/fuel ratio or excess air to account for elevation of the installation of the furnace.

17. The furnace of claim 15 wherein the adjustment input mechanism receives an input of heat delivery characteristics of the fuel gas, and wherein the controller uses the input of heat delivery characteristics of the fuel gas to adjust the air/fuel ratio or excess air to account for heat delivery characteristics of the fuel gas delivered to the furnace.

18. The furnace of claim 1 wherein burner plate is attached by being sandwiched between opposing surfaces so that the burner plate slides against the opposing surfaces when the burner plate expands and contracts as the furnace cycles on and off.

19. A furnace for heating an occupied space while producing lower than standard NOx emissions, the furnace comprising:

an air inlet passage comprising an inlet tube having an inlet end;

a fuel injector mounted at the inlet end of the inlet tube, the fuel injector comprising an orifice that dispenses the fuel, wherein the fuel injector is oriented so that the fuel injector dispenses the fuel into the inlet end of the inlet tube, and wherein space between the fuel injector and the inlet tube permits air to enter the inlet tube around the fuel injector;

a mixing device downstream of the fuel injector that mixes the air and fuel prior to combustion, wherein the mixing device is in addition to the inlet tube, the mixing device is located inside the inlet tube, and the mixing device comprises a flat surface that is substantially perpendicular to the direction of fuel flow exiting the injector and that is located in front of the orifice of the fuel injector;

a burner plate downstream of the mixing device separating unburned air and fuel mixture on an upstream side of the burner plate from burning air and fuel and products of combustion on a downstream side of the burner plate, the burner plate comprising multiple ports therethrough that the air and fuel mixture pass through;

a combustion chamber downstream of the burner plate and defined on an upstream side by the burner plate;

a heat exchanger downstream of the combustion chamber that transfers heat from the products of combustion to air to be delivered to the occupied space; and a fan downstream of the heat exchanger that draws air through the air inlet passage, mixing device, burner plate and combustion chamber, and that draws products of combustion through the heat exchanger.

20. The furnace of claim 19 wherein the flat surface of the mixing device is substantially a circle.

21. A furnace for heating an occupied space while producing lower than standard NOx emissions, the furnace comprising:

an air inlet passage comprising an inlet tube having an inlet end;

a fuel injector mounted at the inlet end of the inlet tube, the fuel injector comprising an orifice that dispenses the fuel, wherein the fuel injector is oriented so that the fuel injector dispenses the fuel into the inlet end of the inlet tube, and wherein space between the fuel injector and the inlet tube permits air to enter the inlet tube around the fuel injector;

a mixing device downstream of the fuel injector that mixes the air and fuel prior to combustion, wherein the mixing device is in addition to the inlet tube, the mixing device is located inside the inlet tube, and the mixing device comprises at least one flat metal plate that is located downstream of the orifice of the fuel injector;

a burner plate downstream of the mixing device separating unburned air and fuel mixture on an upstream side of the burner plate from burning air and fuel and products of combustion on a downstream side of the burner plate, the burner plate comprising multiple ports therethrough that the air and fuel mixture pass through;

a combustion chamber downstream of the burner plate and defined on an upstream side by the burner plate;

a heat exchanger downstream of the combustion chamber that transfers heat from the products of combustion to air to be delivered to the occupied space; and a fan downstream of the heat exchanger that draws air through the air inlet passage, mixing device, burner plate and combustion chamber, and that draws products of combustion through the heat exchanger.

22. The furnace of claim 21 wherein the mixing device is attached to the fuel injector.

23. The furnace of claim 21 wherein the mixing device comprises a piece of sheet metal comprising multiple bends wherein the piece of sheet metal comprises a center and two arms extending from the center to two ends, wherein each arm is separated from the center by a first bend, and wherein each end is separated from one of the arms by a second bend.

24. The furnace of claim 21 wherein the orifice of the fuel injector is located within the inlet end of the inlet tube.

* * * * *